US008034525B2

(12) United States Patent
Matsumoto et al.

(10) Patent No.: US 8,034,525 B2
(45) Date of Patent: Oct. 11, 2011

(54) IMAGE FORMING APPARATUS AND IMAGE FORMING METHOD

(75) Inventors: Yoshiyasu Matsumoto, Tokyo (JP); Kenji Yamane, Kanagawa (JP); Hiroyuki Kozuru, Yamanashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 652 days.

(21) Appl. No.: 12/168,627

(22) Filed: Jul. 7, 2008

(65) Prior Publication Data

US 2009/0035684 A1 Feb. 5, 2009

(30) Foreign Application Priority Data

Jul. 31, 2007 (JP) ..... 2007-198673

(51) Int. Cl.
*G03G 21/00* (2006.01)

(52) U.S. Cl. ..... 430/119.82; 430/119.7; 430/119.86; 430/124.1

(58) Field of Classification Search ..... 430/119.7, 430/119.82, 119.83, 119.86, 124.1, 124.3; 399/346

See application file for complete search history.

(56) References Cited

U.S. PATENT DOCUMENTS

| | | | | |
|---|---|---|---|---|
| 6,653,038 | B2 * | 11/2003 | Matsunaga et al. | 430/108.22 |
| 7,078,142 | B2 * | 7/2006 | Itami et al. | 430/119.72 |
| 2005/0069357 | A1 * | 3/2005 | Kabata et al. | 399/351 |
| 2005/0277044 | A1 * | 12/2005 | Watanabe et al. | 430/109.3 |
| 2007/0059067 | A1 * | 3/2007 | Tanaka et al. | 399/346 |
| 2007/0183824 | A1 * | 8/2007 | Suda et al. | 399/346 |

* cited by examiner

*Primary Examiner* — Mark F Huff
*Assistant Examiner* — Stewart Fraser
(74) *Attorney, Agent, or Firm* — Lucas & Mercanti, LLP

(57) ABSTRACT

An image forming method is disclosed, which includes steps of cleaning toner remaining on a photoreceptor surface by a cleaning blade which is arranged on counter direction to rotation direction of the photoreceptor, supplying a fatty acid metal salt onto the photoreceptor surface after the cleaning, spreading the supplied fatty acid metal salt on the photoreceptor surface by using a spreading blade which is arranged on trail direction to rotation direction of the photoreceptor, charging the photoreceptor by a charging member, exposing the photoreceptor to form a latent image, developing the latent image by a developer to form a toner image on the photoreceptor, and transferring the toner image onto an image receiving member by a transfer roller facing to the photoreceptor through the image receiving material, in which the toner comprises a binder resin and a colorant, in which the toner has a glass transition point of from 20 to 45° C. and the binder resin contains 50% or more of vinyl polymer resin by weight based on the whole weight of the binder resin.

17 Claims, 5 Drawing Sheets

IMAGE FORMING APPARATUS AND IMAGE FORMING METHOD

This application is based on Japanese Patent Application No. 2007-198673 filed on Jul. 31, 2007, the entire content of which is hereby incorporated by reference.

TECHNICAL FIELD

The present invention relates to an image forming apparatus and an image forming method.

BACKGROUND ART

Recently, necessity of reducing of electric power consumption and amount of wastes wholly caused by image forming apparatus is raised for corresponding to energy and resource saving.

In the image forming apparatus, the amount of electric power consumed by the fixing device is large and reducing such the electric power is effective as the energy saving means. As the resources saving means, it is effective to reduce the amount of scrapped photoreceptor by prolonging the using period by the lifetime of the photoreceptor.

At the present time, the use of low temperature fixing toner for reducing the electric power consumed by the fixing device and the prolongation of the lifetime of the photoreceptor for reducing the amount of scrapping materials are demanded.

Investigation for lowering the glass transition temperature of the toner is carried out to obtain the toner effective for reducing the electric consumption by lowering the setting temperature in the fixing device; cf. Patent Publication 1 for example.

Moreover, it is investigated to prolong the lifetime of the photoreceptor by improving the cleaning suitability by lowering the friction coefficient with the cleaning blade by coating a lubricant on the surface of the photoreceptor for realizing the prolongation of the lifetime of the photoreceptor; cf. Patent Publication 2 for example.

However, a problem of internal lacking of image, hereinafter referred to as internal image lacking, is caused at the characters and dots portion of the printed image when an image printed by applying a toner having a glass transition point of from 20 to 45° C. to an image forming apparatus having a transfer roller.

Patent Publication 3 discloses an image forming apparatus comprising a cleaning blade and a lubricant applying element so that the cleaning area and the lubricant applying area overlap.

Furthermore, digital technology is recently introduced in the technical field of image formation by the electrophotographic system such as copiers and printers for raising the image quality; therefore, it is required to exactly reproduce the image of lines and dots equally in a convenient printing system.

Patent Publication 1: JP A 2001-175025
Patent Publication 2: JP A 2005-352009
Patent Publication 3: WO 2006/062229 A1

SUMMARY OF THE INVENTION

An object of the invention is to provide an image forming apparatus and an image forming method by which occurrence of internal image lacking in the portion of characters and dots of the printed image is prevented even when a lot of printing such as 200,000 prints is carried out by using the toner having a glass transition point of from 20 to 45° C.

Embodiments of this invention are described.

The image forming method comprising steps of;

cleaning a toner remaining on a photoreceptor surface by a cleaning blade which is arranged on a counter direction to a rotation direction of the photoreceptor, supplying a fatty acid metal salt onto the photoreceptor surface after the cleaning, spreading the supplied fatty acid metal salt on the photoreceptor surface by using a spreading blade which is arranged on a trail direction to the rotation direction of the photoreceptor, charging the photoreceptor by a charging member, exposing the photoreceptor to form a latent image, developing the latent image by a developer to form a toner image on the photoreceptor, and transferring the toner image onto an image receiving member by a transfer roller facing to the photoreceptor through the image receiving material, wherein the toner comprises a binder resin and a colorant, in which the toner has a glass transition point of from 20 to 45° C. and the binder resin contains 50% or more of a vinyl polymer resin by weight based on the whole weight of the binder resin.

The vinyl polymer resin is preferably composed of one or more kinds of monomers selected from the group consisting of styrene or its derivatives, methacrylic acid ester or its derivatives, acrylic acid ester or its derivatives, acrylic acid and methacrylic acid.

The binder resin preferably contains 80% or more of the vinyl polymer resin by weight based on the whole weight of the binder resin.

THE BEST MODE FOR CARRYING OUT THE INVENTION

The image forming apparatus and the image forming method of the invention is excellent in that the occurrence of internal image lacking at the character and dot portions of the printed image is prevented.

The image forming apparatus in which a toner image is formed on the photoreceptor surface and the toner image is transferred onto an image receiving material through the transfer roller and then the toner not transferred and remaining on the photoreceptor surface is subjected to cleaning is suitable for printing many prints with high speed from the view point of lifetime of the photoreceptor.

A toner capable of being fixed at low temperature is investigated for reducing the electric consumption. It is effective to lower the glass transition point (Tg) of the toner for improving the low temperature fixing ability.

However, the use of the low temperature fixable toner causes sometime the internal image lacking at the portion of characters and dots on the occasion of the transferring the toner image onto an intermediate transfer member or the image receiving material.

Such the phenomenon is considerably caused by lowering in the glass transition point of the toner. It is assumed that such the fact tends to be caused by the adhesion force of the toner to the photoreceptor is raised by rising the softness of toner when the toner is pressed by the transfer roller so that the transfer of the toner image to the image receiving material by electrostatic force is difficultly performed.

Figure 1:
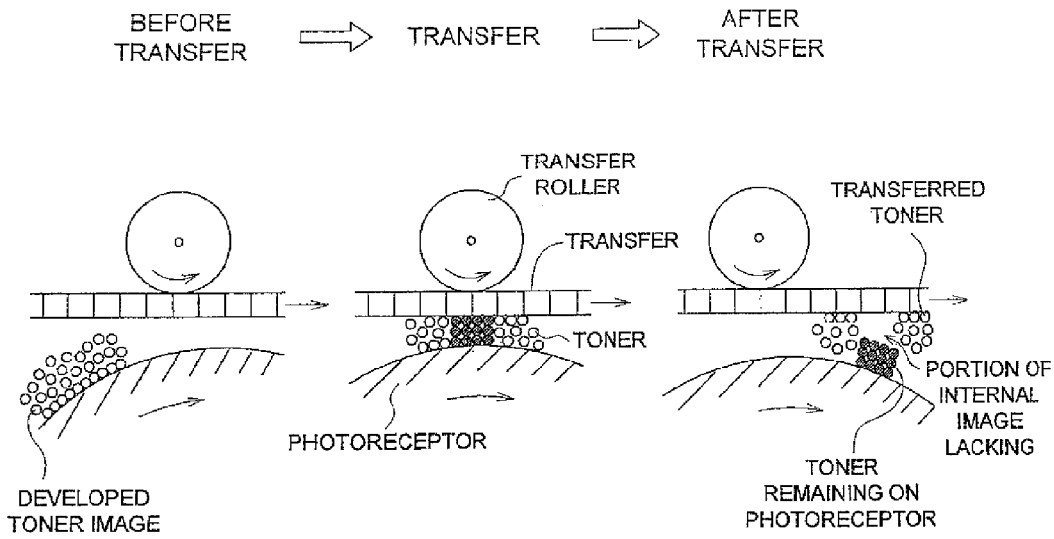
FIG. 1 PRIOR ART
FIG. 1 is a schematic drawing showing the mechanism of occurrence of the internal image lacking in the characters and dots.

FIG. 1 is a schematic drawing showing the mechanism of causing the internal image lacking in the character or dot image.

The adhesion force of the toner to the photoreceptor surface at the portion where the toner is pressed to the photoreceptor by the transfer roller is strengthen so that the toner at the pressed portion is not transferred by electrostatic force and left on the receptor surface when no fatty acid metal salt layer is on the photoreceptor surface shown in FIG. 1. Thus formed toner remaining portion causes the internal image lacking.

The pressing of the toner is strongly caused at central portion of the dot. Therefore, the internal image lacking tends to be caused at the internal portion of the dot.

It is assumed that the lowering in the surface energy is effective as the countermeasure of such the phenomenon.

Figure 2:
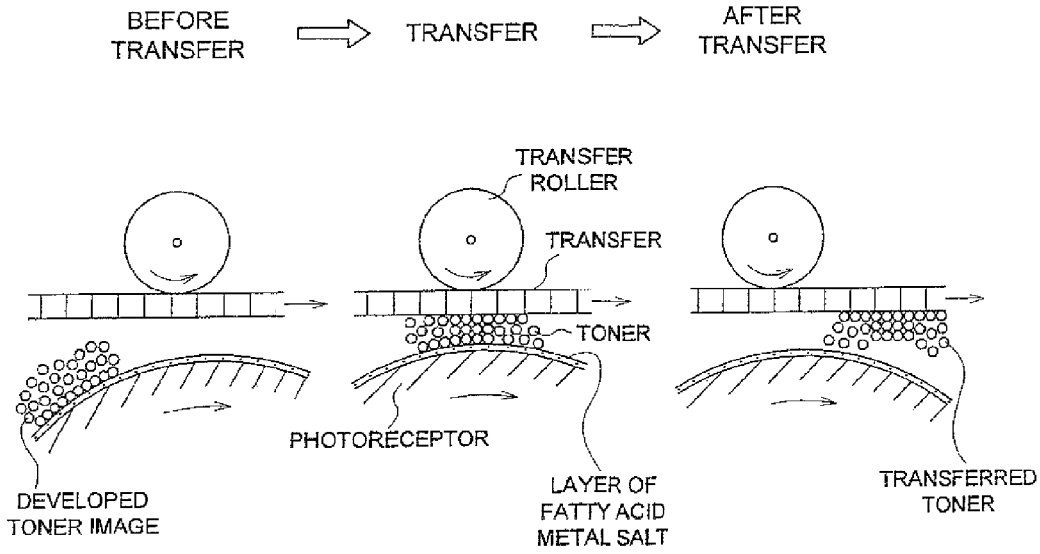
FIG. 2 is a schematic drawing showing the mechanism of prevention of the internal image lacking in the characters and dots.

FIG. 2 is a schematic drawing showing the mechanism of prevention of occurrence of the internal image lacking at the character and dot portions.

On the surface of the photoreceptor on which no fatty acid metal salt layer is formed, the toner at the portion pressed by the transfer roller can be transfer by static electricity because the surface energy of the photoreceptor is lowered so that no toner is left on the photoreceptor surface. As a result of that, the internal image lacking can be prevented.

The inventors have investigated the means for effectively lowering the surface energy of the photoreceptor and attained the image forming apparatus of the invention.

it is effective for lowering the surface energy of the photoreceptor that the toner remaining on the photoreceptor surface after transfer is removed by the cleaning means by the counter type blade and then the fatty acid metal salt is supplied onto the photoreceptor surface by the fatty acid metal salt supplying means such as a brush and the supplied fatty acid metal salt is spread on the photoreceptor surface by the trail type blade to form a fatty acid metal salt layer for lowering the surface energy.

The trail type blade of the invention is a blade attached in the trail direction to the rotation direction of the photoreceptor so that the blade is touched to the photoreceptor at an obtuse angle, preferably such as 170°. The trail type blade is suitable for spreading the fatty acid metal salt supplied onto the surface of the photoreceptor because the blade is arranged so that the blade is touched with pressure to the photoreceptor.

It is preferable to lower the surface energy by not more than 40 mN/m and preferably not more than 30 mN/m by forming the fatty acid metal salt layer on the photoreceptor surface.

The surface energy of a solid substance is calculated according to expanded Fowkes theory based on the consideration of adhesion work by measuring the contacting angle of a liquid having a known surface energy such as methylene iodide on the solid substance to be subjected to measurement; cf. Handling Specification of Surface free energy analyzing software EG-11 manufactured by Kyowa Interface Science Co., Ltd.

The contact angle to methylene iodide is determined by averaging results of measurement for five times by a contact angle measuring apparatus Contact Angle Meter CA-V, manufactured by Kyowa Interface Science Co., Ltd. The larger contact angle corresponds to lower surface energy.

The image forming apparatus of the invention is described below.

The image forming apparatus of the invention has the transfer means which has the transfer roller facing to the photoreceptor through the image receiving material, and (1) the means for cleaning the remaining toner on the photoreceptor surface after the transfer by the counter type blade, (2) the means for supplying the fatty acid metal salt on to the photoreceptor surface after the cleaning by using the supplying member, and (3) the means for spreading the supplied fatty acid metal salt on the photoreceptor surface by using the supplying member, which are provided after the transfer means in the order of (1), (2) and (3).

Figure 4:
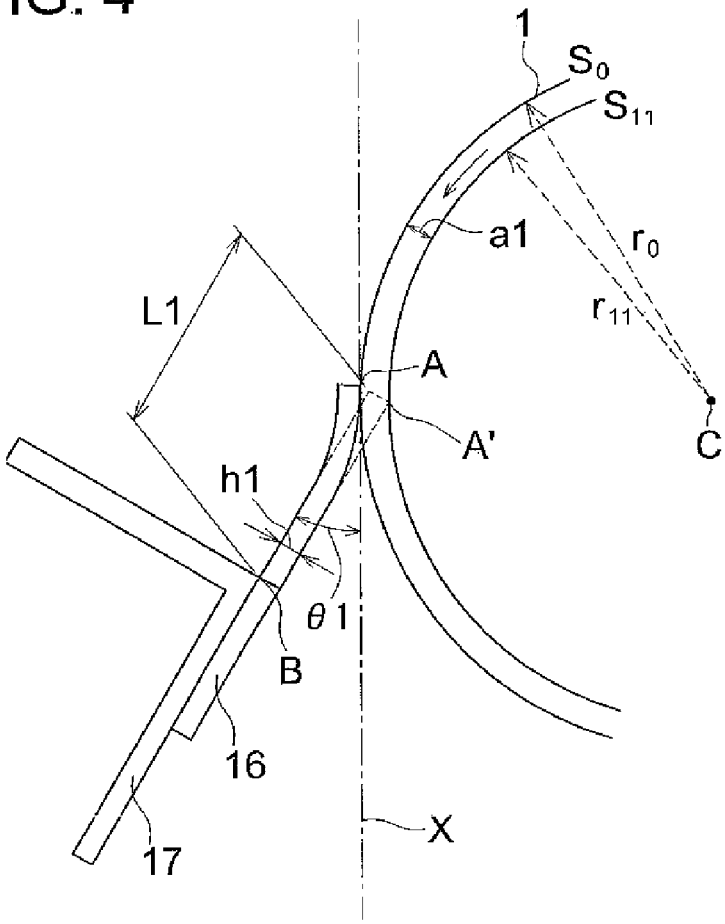
FIG. 4 is a schematic drawing showing an example of cleaning means using a cleaning blade.

The counter type blade is a blade attached in the counter direction to the rotation direction of the photoreceptor (reverse direction to the advancing direction) so that the blade is touched to the photoreceptor at an acute angle such as not more than 90°, for example 20°, in the angle θ1 in FIG. 4. The counter type blade is suitable for cleaning the remaining toner on the surface of the photoreceptor because the blade is arranged so that the blade is touched to the photoreceptor at the acute angle.

Figure 5:
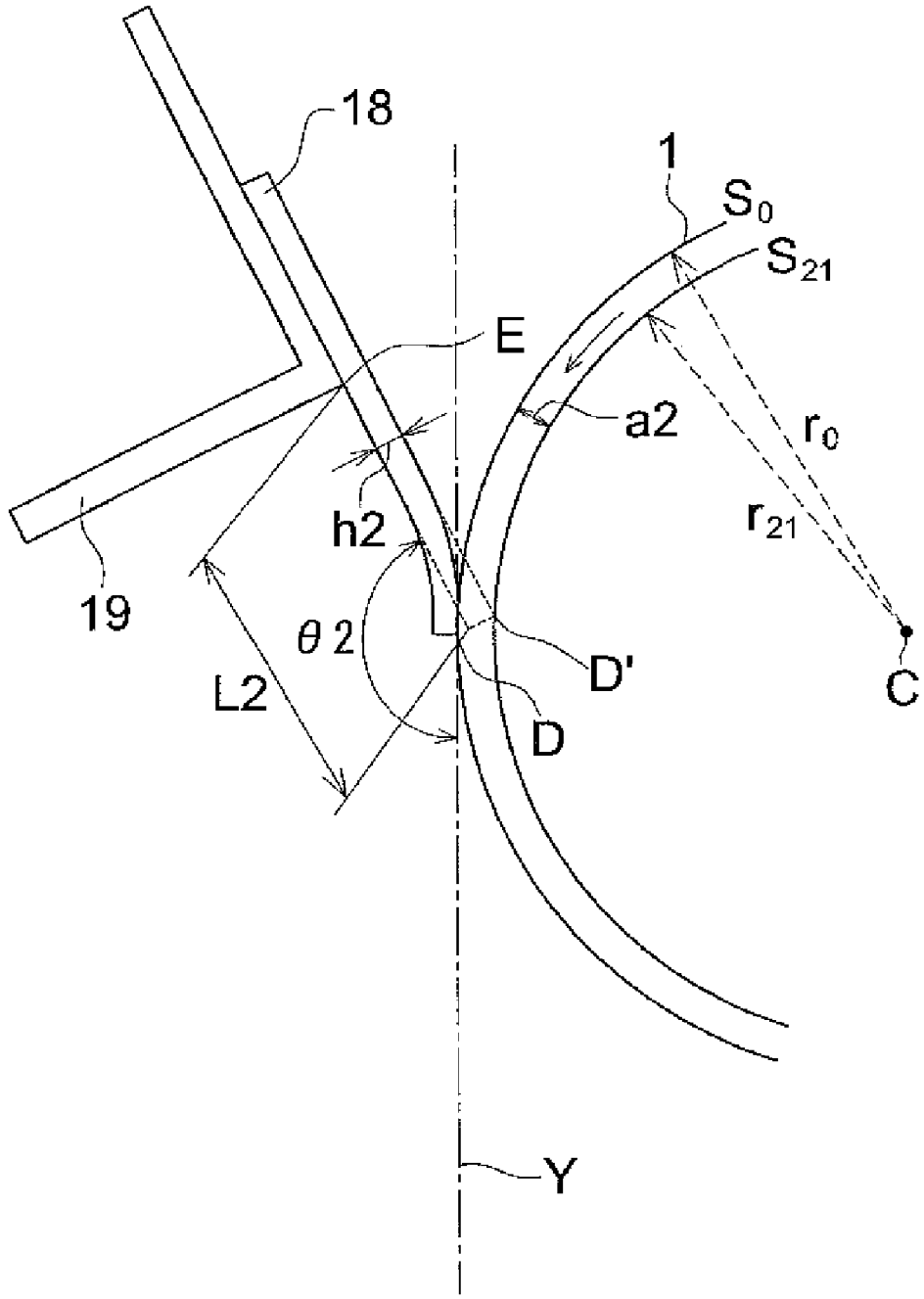
FIG. 5 is a schematic drawing showing an example of spreading means using a spreading blade.

The trail type blade is a blade attached in the trail direction to the rotation direction of the photoreceptor so that the blade is touched to the photoreceptor at an obtuse angle such as not less than 90°, for example 170°, in the angle θ2 in FIG. 5. The trail type blade is suitable for spreading the fatty acid metal salt supplied onto the surface of the photoreceptor because the blade is arranged so that the blade is touched with pressure to the photoreceptor.

The surface energy of the photoreceptor can be lowered by forming the layer of fatty acid metal salt on the photoreceptor surface after cleaning of the remaining toner by supplying and spreading the fatty acid metal salt layer onto the photoreceptor surface. As a result of that, the occurrence of internal image lacking can be prevented even when the image is formed by the toner having a low glass transition point of from 20 to 45° C.

The fatty acid metal salt, cleaning means, supplying means and spreading means are described below.

[Fatty Acid Metal Salt]

The fatty acid metal salt is used for lowering the surface energy of the photoreceptor. Concretely, the fatty acid metal salt is supplied onto the surface of photoreceptor by the later-mentioned supplying means such as a brush and spread by the trail type blade to form the layer for lowering the surface energy or the photoreceptor.

The fatty acid metal salt is a practically preferable material because it can be formed into a uniform layer on the photoreceptor surface and formed layer does not give any bad influence on the image formation and the toner difficultly adheres to the layer.

The fatty acid metal salt to be used in the invention is preferably a metal salt of a saturated or unsaturated fatty acid having 10 or less carbon atoms. Concretely, calcium stearate, aluminum stearate, indium stearate, gallium stearate, zinc stearate, lithium stearate, magnesium stearate, sodium stearate, aluminum palmitate and aluminum oleate are cited.

Among the fatty acid metal salts, ones having high flowing rate in a flow tester are high in the cleaving ability and the layer thereof can be effectively formed on the photoreceptor surface. The flowing rate is preferably from $1\times10^{-7}$ ml/sec to $1\times10^{-1}$ ml/sec and more preferably from $5\times10^{-4}$ mol/sec to $1\times10^{-2}$ ml/sec.

The measuring method of the flowing rate is described below.

Under a condition of 20° C.±1° C. and 50±5% of RH, 1.0 g of fatty acid metal salt is put into a Petri dish and made even. After standing for 12 hours, the meat salt is pressed by a pressure of 3820 kg/cm$^2$ for 30 seconds to prepare a pillar-shaped sample having a diameter of 1 cm.

The measurement is carried out by using a flow tester CFT-500D, manufactured by Shimadzu Corp., under a condition of 24° C.±5° C. and 50±20% of RH. The above prepared sample is extruded through the hole (1 mm×1 mm) of columnar die after preheating for 300 seconds by a piston having a diameter of 1 cm with a load of 196 N (20 kgf) under a condition of a starting temperature of 50° C. and a temperature raising rate of 6° C./minute to measure the flow rate.

As the fatty acid metal salt having the flow rate within the above preferable range, zinc stearate, aluminum stearate and calcium stearate can be cited.

The fatty acid metal salt can be supplied to the supplying means in a form of a block or powder and one formed in a block shape is preferred. Concretely, it is preferable that the salt is formed in a block having a width of from 2 to 5 mm, a height of from 2 to 10 mm and a length of from 300 to 350 mm.

Next, the cleaning means, supplying means and spreading means are described below.

Figure 3:
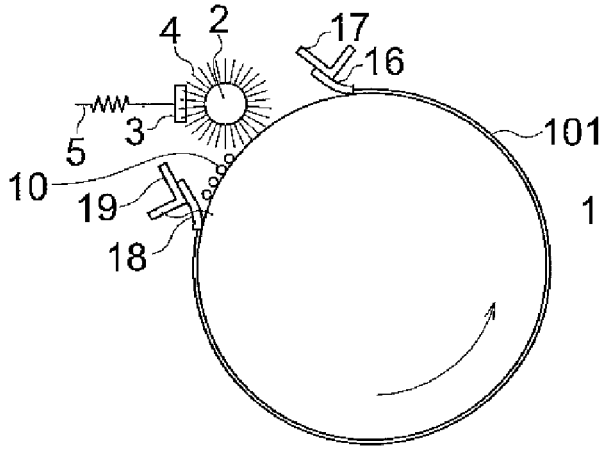
FIG. 3 is a schematic drawing showing an example of cleaning means, fatty acid metal salt supplying means and spreading means.

FIG. 3 shows a schematic drawing of an example of image forming apparatus having the cleaning means, supplying means and spreading means arranged around the photoreceptor.

In FIG. 3, 1 is the photoreceptor, 2 is a brush holder, 3 is the fatty acid metal salt block, 4 is a brush, 5 is a member for deciding the position of the brush, 16 is a cleaning blade, 17 is a cleaning brush holder, 18 is the spreading blade, 19 is a cleaning blade holder, 10 is the supplied fatty acid metal salt and 101 is the layer of fatty acid metal salt.

The counter type cleaning blade 16 is provided in the image forming apparatus shown in FIG. 3 for cleaning the remaining toner. The brush 4 for supplying the fatty acid metal salt 10 onto the photoreceptor surface from the fatty acid metal salt block 3 is provided on the downstream side the rotation direction of the photoreceptor. The trail type blade 8 is provided on the downstream side for spreading the supplied fatty acid metal salt to form the layer of fatty acid metal salt 101.

<<Cleaning Means>>

The toner remaining on the photoreceptor surface is removed by the cleaning means using the counter type cleaning blade.

The cleaning blade is set in the counter direction to the rotation direction of the photoreceptor so that the angle (touching angle) between the photoreceptor and the corner edge touching with the photoreceptor surface is made an acute angle.

The cleaning blade is preferably touched to the photoreceptor with a line pressure of from 5 to 50 N/m form the viewpoint of raising the cleaning ability. Cleaning fault is hardly caused and turn over of the blade is difficultly caused when the touching pressure is within the above range. As the method for touching the blade, a method by which the position of cleaning is previously decided and the blade is fixed, a method by which the spring load is controlled and a method in which a spring is utilized, and the spring load controlling method is preferred for reducing the fluctuation of the touching pressure.

A charge elimination process for eliminating the charge on the photoreceptor surface is preferably added at the previous step of the cleaning for making easy the cleaning. The charge elimination process is carried out, for example, by a charge eliminator causing alternative corona discharge.

FIG. 4 is a schematic showing an example of cleaning means using the counter type cleaning blade.

In FIG. 4, the photoreceptor and the touching angle of the blade is represented by 1 and θ1, respectively. The free length L1 of the blade 16 is the length of from the end B of a blade holder 17 to the top end A' of the blade assumed that it is not deformed (shown by broken line in the drawing). The thickness of the blade is shown by h1. The blade touching angle θ1 is an angle made by a tangential line X at the touching point A of the photoreceptor and the blade assumed that it is not deformed. Digging depth a1 is the difference between the diameter $r_0$ of the circumstance $S_0$ of the photoreceptor and the diameter $r_{11}$ of the circle $S_{11}$ formed by the top point A' of the blade assumed that it is not deformed and the center axis C of the photoreceptor. The touching angle θ1 of the cleaning blade with the photoreceptor is preferably from 5° to 35°. The cleaning fault of the toner remaining after transfer and turning up of the glade (a state in which the top of the blade is turned from the counter direction into the rotating direction of the photoreceptor) is not caused when the touching angle is within the above range.

The free length of the cleaning blade is preferably from 6 to 15 mm and the thickness of the cleaning is preferably from 0.5 to 10 mm.

As the material of the cleaning blade, urethane rubber, silicone rubber, fluorine-containing rubber, chloroprene rubber and butadiene rubber are usable. Among them, urethane rubber is preferable because it is excellent in the anti-wearing property.

The shape and the material of the cleaning blade can be suitably decided depending on various conditions such as the kind of fatty acid metal salt and the layer thickness thereof, properties of the toner, properties of the photoreceptor and the touching angle and pressure of the cleaning blade.

<<Supplying Means>>

As the means for supplying the fatty acid metal salt onto the photoreceptor surface, means used for a supplying member such as the brush and a web roller and a means by directly touching the fatty acid metal salt block can be cited. Among them, the brush capable of stably supplying the fatty acid metal salt is preferred.

The means for supplying the fatty acid metal salt onto the photoreceptor surface is described below.

In the supplying means using the brush, the brush is touched to the block of fatty acid metal salt while rotating to put the fatty acid metal salt on the brush and the fiber of the brush carrying the fatty acid metal salt is touched to the photoreceptor surface to supply the fatty acid metal salt onto the photoreceptor surface.

The supplying amount of the fatty acid metal salt can be controlled into preferable range by suitably controlling the rotation number of the brush, fiber of the brush, digging depth of the brush into the photoreceptor and the rotation directions of the photoreceptor and the brush for example.

The thickness of the fiber is preferably from 10 to 50 denier (weight in gram of fiber of 9,000 m) and the digging depth into the photoreceptor is preferably from 0.4 to 1.5 mm. The digging depth is defined by the largest digging value of the top point of fiber into the photoreceptor when it is assumed that photoreceptor is not present.

The supplying amount of the fatty acid metal salt onto the photoreceptor surface is preferably from 0.1 to 0.5 mg/$m^2$ and more preferably from 0.1 to 0.3 mg/$m^2$. The surface energy of the photoreceptor surface can be lowered by a level where the occurrence of the internal image lacking can be prevented by spreading the supplied fatty acid metal salt to form the layer by the spreading means. Any problems such as increasing in the remaining potential and a lowering in the sensitivity are not caused even when such the degree of the fatty acid metal salt layer is provided on the photoreceptor surface.

The supplying amount of the fatty acid metal salt onto the photoreceptor surface is obtained by that the reduced amount (mg) of the fatty acid metal salt block caused by printing of 10,000 sheets by the image forming apparatus is measured and the reduced amount is divided by the area ($m^2$) corresponding to the 10,000 printed sheets.

<<Spreading Means>>

The fatty acid metal salt supplied onto the photoreceptor surface is spread on the photoreceptor surface by the spreading means to form the layer.

The trail type spreading blade is used for the spreading means.

The spreading blade is set in the trail direction to the rotation direction of the photoreceptor and the angle made by the photoreceptor and the corner edge touching to the photoreceptor is set at an obtuse angle.

FIG. 5 is a schematic drawing showing an example of spreading means using the spreading blade.

In FIG. 5, the photoreceptor and the touching angle of the blade is represented by 1 and θ2, respectively. The free length L2 of the blade 18 is the length of from the end E of the blade holder 19 to the top end D' of the blade assumed that it is not deformed (shown by broken line in the drawing). Symbol h2 is a thickness of the blade. The blade touching angle θ2 is an angle made by a tangential line Y at the touching point D of the photoreceptor and the blade assumed that it is not deformed (shown by broken line in the drawing). Digging depth a2 is the difference between the diameter $r_0$ of the circumstance $S_0$ of the photoreceptor and the diameter $r_{21}$ of the circle $S_{21}$ formed by the top point D' of the blade assumed that it is not deformed and the center axis C of the photoreceptor. The touching angle θ2 of the spreading blade to the photoreceptor is preferably from 135° to 180°. The free length is preferably from 6 to 15 mm and the thickness is preferably from 0.5 to 10 mm.

The spreading blade is set in the trail direction by making the touching angle to obtuse angle so that the fatty acid metal salt can be effectively spread suitably for forming the uniform layer.

The touching force is preferably from 10 to 20 N/m. The pressure to the photoreceptor can be made small and the layer of the fatty acid metal salt can be uniformly formed by setting the touching force within the above range.

As the material of the spreading blade, urethane rubber, silicon rubber, fluorine-containing rubber, chloroprene rubber and butadiene rubber can be used. Among them urethane rubber is preferable since that is excellent in the anti-wearing ability.

The shape and material of the spreading blade can be suitably decided according to various conditions such as the kind of the fatty acid metal salt, thickness of the layer, properties of the toner, properties of the photoreceptor, and the touching angle and force of the spreading blade.

Good transfer property is guaranteed by transfer means employing a transfer roller in high speed image forming process.

The image forming method by transferring toner image on a photoreceptor to transfer material includes one in which the toner image is transferred to a primary transfer member first then secondary transferred to the transfer member, and the other in which the toner image on the photoreceptor is transferred directly to the transfer material. This invention can be applied to both way.

The image forming apparatus is described, in which a toner image is primarily transferred to an intermediate transfer material then secondarily transferred to a transfer material.

Figure 6:
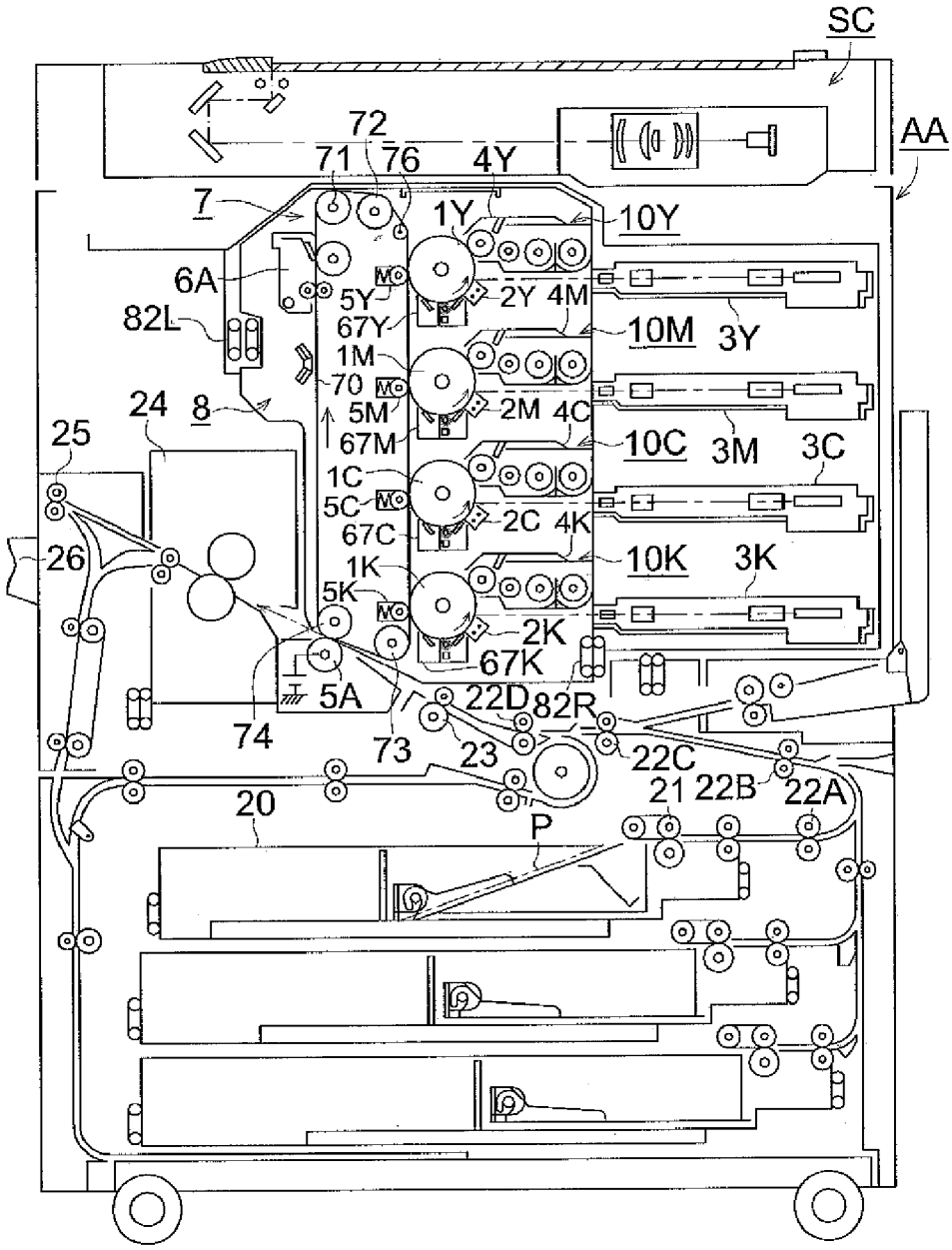
FIG. 6 is a schematic drawing showing an example of image forming apparatus of the invention.

FIG. 6 is a schematic view of an example of an apparatus which can be applied to the image forming method.

The symbols 1Y, 1M, 1C and 1K are each a photoreceptor, 2Y, 2M, 2C and 2K are each a charging member, which gives charge on each of the photoreceptor, 4Y, 4M, 4C and 4K are each a developing member, 5Y, 5M, 5C and 5K are each a first transfer roller, 5A is a second transfer roller, 67Y, 67M, 67C and 67K are each a unit comprising a cleaning member, metal salt of fatty acid and its spreading member, 24 is a thermal roll fixing device, and 70 is an intermediate transfer member in FIG. 6. The charging member is preferably gives charge without contacting, such as a corona discharger.

The image forming apparatus is one so called a tandem type color image forming apparatus, in which plural image forming members 10Y, 10M, 10C and 10Bk, an endless belt-shaped intermediate transferring unit 7 as a transfer member, an endless belt shaped paper supplying and conveying member 21 which conveys a recording material P and a thermal roller fixing device 24 as a fixing member are equipped. An original image reading device SC is arranged at the upper portion of the main body AA of the image forming apparatus.

The image forming unit 10Y for forming a yellow colored image, which is an example of color toner image on each photoreceptor, has a drum-shaped photoreceptor 1Y, and a charging member 2Y arranged around the photoreceptor 1Y, an exposing member 3Y, a developing member 4Y, a primary transferring roller 5Y and a unit comprising a cleaning member, metal salt of fatty acid and its spreading blade 67Y which are arranged around the photoreceptor 1Y. The image forming unit 10M for forming a magenta colored image has a drum-shaped photoreceptor 1M, and a charging member 2M arranged around the photoreceptor 1M, an exposing member 3M, a developing member 4M, a primary transferring roller 5M and a unit comprising a cleaning member, metal salt of fatty acid and its spreading blade 67M which are arranged around the photoreceptor 1M. The image forming unit 10C for forming a magenta colored image has a drum-shaped photoreceptor 1C, and a charging member 2C arranged around the photoreceptor 1C, an exposing member 3C, a developing member 4C, a primary transferring roller 5C and a unit comprising a cleaning member, metal salt of fatty acid and its spreading blade 67C which are arranged around the photoreceptor 1C. The image forming unit 10K for forming a magenta colored image has a drum-shaped photoreceptor 1K, and a charging member 2K arranged around the photoreceptor 1K, an exposing member 3K, a developing member 4K, a primary transferring roller 5K and a unit comprising a cleaning member, metal salt of fatty acid and its spreading blade 67K which are arranged around the photoreceptor 1K.

The endless belt-shaped intermediate transferring unit 7 has an endless belt-shaped intermediate transfer member 70 which is wound on plural rollers and circulatably held.

Each toner image formed in the image forming units 10Y, 10M, 10C and 10K, respectively, is successively transferred onto the circulating endless belt-shaped intermediate transfer member 70 by the primary transferring rollers 5Y, 5M, 5C and 5Bk, thus a color image is synthesized. Paper P as a recording material stocked in a paper supplying cassette 20 is supplied and conveyed by a paper supplying and conveying member 21, to a secondary transferring roller 5A as a secondary transfer member through plural intermediate conveying rollers 22A, 22B, 22C and 22D and a register roller 23. Then the color image is collectively transferred by the secondary transfer member onto the paper P. The color image transferred on the paper P is fixed by the fixing member 24 and conveyed by an output roller 25 to be stood on an output tray 26.

The toner remained on the endless belt intermediate transfer member 70 is removed by the cleaning member 6A after the color image is transferred to the paper P by the secondary transferring roller 5A and the paper P is separated by curvature from the intermediate transferring belt.

The primary transferring roller 5K is constantly pressed to the photoreceptor 1Bk in the course of image formation process. The other primary transferring rollers 5Y, 5M and 5C are each contacted by pressing to the corresponding photoreceptors 1Y, 1M and 1C, respectively, only for the period of image formation.

The secondary transferring roller 5A is contacted by pressing to the endless belt-shaped intermediate transfer member 70 only for the period of the secondary transferring while passing of the paper P.

A frame 8 can be pulled out from the main body AA of the apparatus through supporting rails 82L and 82R.

The frame 8 includes the image forming units 10Y, 10M, 10C and 10K, and an intermediate transferring unit 7 comprising the endless belt-shaped intermediate transfer member 70.

The image forming units 10Y, 10M, 10C and 10Bk are serially arranged in the perpendicular direction. In the drawing, the endless belt-shaped intermediate transferring unit 7 is arranged at left side of the photoreceptors 1Y, 1M, 1C and 1K. The endless belt-shaped intermediate transferring unit 7 included the circulatable endless belt-shaped intermediate transfer member 70 wound with the rollers 71, 72, 73, 74, and 76, the primary transferring rollers 5Y, 5M, 5C and 5K, and the cleaning member 6A.

The image forming units 10Y, 10M, 10C and 10Bk can be pulled out from the main body AA together with the endless belt-shaped intermediate transferring unit 7 when the frame 8 is pulled out.

As above-mentioned, toner images are each formed on the photoreceptors 1Y, 1M, 1C and 1K and accumulated on the endless belt-shaped intermediate transfer member 70, and then collectively transferred onto the recording medium P and fixed by heating and pressing by heat roll fixing device 24. The photoreceptors 1Y, 1M, 1C and 1K are subjected to cleaning by removing the toner remaining thereon by the cleaning members, respectively, after transferring toner images to the intermediate transfer member 70. Then thin layer of a metal salt of a fatty acid is formed on the surface of the photoreceptors, by supplying and spreading the metal salt of a fatty acid on the surface of the photoreceptors. After that, the image formation is repeated by the next cycle of the charging, exposing and developing.

A fixing device having heat roller is preferably employed for fixing toner image on a recording material.

Figure 7:
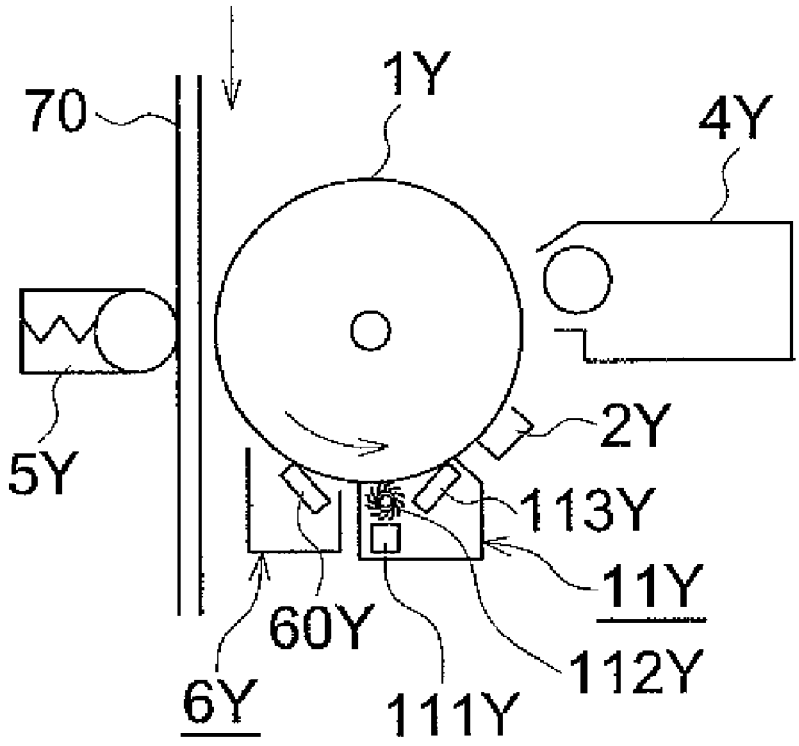
FIG. 7 is an enlarged schematic drawing around the image forming portion.

FIG. 7 is a schematic view of enlarged part around the yellow image forming member 10Y of FIG. 6.

As is shown in FIG. 7, 6Y is a cleaning member, 60Y is a cleaning blade, 11Y is a member to supply and spread the metal salt of fatty acid, 111Y is metal salt of fatty acid, 112Y is a supply brush and 113Y is spreading blade.

A cleaning blade, a brush and an extending blade are arranged in this order for the rotation direction of the photoreceptor as shown in FIG. 7.

Rotation direction of the brush is preferably arranged in counter direction with reference to the direction of the photoreceptor. The brush is provided so that peripheral of the brush is made contact with the photoreceptor always.

The metal salt of fatty acid is constantly pressed so as to contact with the circumference part of the brush by a spring toward the brush. Therefore, end of the brush rubs off the surface of metal salt of fatty acid to supply and make adhered to the metal salt of fatty acid to the surface of the photoreceptor when the brush turns round.

The charging roller, the developing member, the cleaning member and the supplying and spreading member of the metal salt of fatty acid are provided in each image forming device for respective colors.

Toner employed in this invention is described.

<<Toner>>

Toner is one which exhibits a glass transition temperature of 20-45° C., more preferably 20-40° C., that is suitable for low temperature fixing.

The toner having Tg mentioned above has no problem in storage ability at high temperature and is excellent in low temperature fixing ability.

Species and amount of polymerizable monomers are controlled so as to obtain the Tg of 20-45° C. Propyl acrylate, propylmethacrylate, butylacrylate, 2-ethyhexylacrylate and laurylacrylate are example of polymerizable monomers to give lower Tg resin, and styrene, methylmethacrylate and methacrylic acid are example of polymerizable monomers to give higher Tg resin.

The glass transition point of the toner can be measured by employing, for example, "DSC-7 DIFFERENTIAL CALORIMETER" (produced by Perkin Elmer Corp.) or "TAC7/DX THERMAL ANALYSIS UNIT CONTROLLER" (produced by Perkin Elmer Corp.).

In practice, about 4.5 to 5.0 mg of toner was collected and its weight was determined down to an accuracy of 0.01 mg. The resultant sample was sealed in an aluminum pan (KIT No. 0219-0041) and placed in a DSC-7 sample holder. An empty aluminum pan was employed for the reference measurement. The measurement was conducted with heat-cool-heat temperature control, in which the conditions are: a measurement temperature of 0-200° C., a temperature rising rate of 10° C./minute, and a temperature cooling rate of 10° C./minute, with temperature control of "Heat-Cool-Heat" mode, and analysis was carried out based on data during the 2nd heating.

The glass transition temperature is obtained as follows. An extension of the base line prior to elevation of the first endothermic peak and a tangential line, which exhibits the maximum inclination between the first peak elevation position and the peak top, are drawn and the resulting intersection is regarded as the glass transition point.

(Molecular Weight of Resin)

It is preferred that weight average molecular weight (Mw) of resin composing the toner is 10,000 to 100,000, number average molecular weight (Mn) is 5,000 to 50,000 and Mw/Mn is 2 to 4.

Tg can be controlled by selecting the monomer species and their proportion as well as molecular weight of the resin described above. Resins having Mw/Mn of 2 to 4 is preferable because of preventing imperfect fixing.

The molecular weight of resins can be determined by gel permeation chromatography (GPC) in the following method.

As the GPC method, a measurement sample is dissolved in tetrahydrofuran at a concentration of 1 mg/ml. Dissolution is conducted by using an ultrasonic homogenizer for 5 min. at room temperature. Subsequently, after treated in a membrane filter of 0.2 μm pore size, 10 μl of a sample solution was injected into the GPC.

Condition of GPC measurement is described.

Apparatus: HLC-8220 (produced by TOSOH CORP.)

Column: TSK guard column+TSK gel Super HZM-M3 (produced by TOSOH CORP.)

Column temperature: 40° C.

Solvent: tetrahydrofuran

Flow rate: 0.2 ml/min

Detector: refractive index detector (RI detector)

In the molecular weight measurement of a sample, the molecular weight distribution of the sample is calculated using a calibration curve prepared by using monodisperse polystyrene standard particles. About 10 points are preferably used as polystyrene for the calibration curve.

(Particle Diameter of the Toner)

It is preferable that the particle diameter of a toner particle is specifically a volume-based median diameter ($D_{50}$) of 3-8 μm. The toner having such particle diameter can reproduce high quality image.

The volume-based median diameter ($D_{50}$) of toner particles can be determined by the following method.

Specifically, it is measured and calculated by using Coulter Multisizer 3 (Beckman Coulter Co.), connected to a computer system (Beckman Coulter Co.) installed with data processing "Software V 3.51)".

The measurement procedure is as follows: 0.02 g of toner particles are added to 20 ml of a surfactant solution (for example, a surfactant solution obtained by diluting a surfactant containing neutral detergent with pure water to a factor of 10) and dispersed in an ultrasonic homogenizer to prepare a toner dispersion. Using a pipette, the toner dispersion is placed into a beaker containing ISOTON II (produced by Beckman Coulter Co.) within a sample stand, until reaching a measurement concentration of 5-10%. The measurement particle count number was set to 25,000 to perform measurement. Then aperture diameter was 50 μm. The measurement range of 1 to 30 μm was divided into 256 portions to determine the frequency number. A particle size corresponding to 50% of the volume-integrated fraction from the larger particles was defined as a volume-based median diameter.

The toner according to this invention can be prepared by, adding an external additive if necessary, to a mother particles (or colored particles) comprising a binder resin, a colorant and a releasing agent.

The toner relating to the invention is preferably one having a core/shell structure. It is preferable that the glass transition point of the resin constituting the shell is made higher than that of the resin constituting the core so that the toner is difficulty deformed by stress.

A production method by emulsion association is preferably applied though the method for producing the toner is not specifically limited. Particularly, a production method is preferred by which resin particles prepared by multi-step synthesizing by emulsion polymerization of mini-emulsion polymerized particles are associated (coagulation and fusion).

An example of procedure for producing the toner relating to the invention is described below.

(1) A dissolution/dispersion process for dissolving or dispersing wax into a radical polymerizable monomer (2) A polymerization process for preparing a dispersion of resin particle (3) A coagulation/dispersion process for coagulating and fusing resin particles and colorant particles to form associated particles (4) A first ripening process for controlling the shape of the associated particles by thermal energy by ripening to produce core particles (5) A shell forming process for forming core/shell-structure colored particles by coagulating and fusing shell forming resin particles onto the surface of core particles by adding the shell forming resin particles (6) A second ripening process for thermally controlling the shape of core/shell-structured colored particles by energy of ripening (7) A washing process for cooling the core/shell-structured colored particle dispersion, separating the colored from the cooled dispersion and removing a surfactant from the separated colored particles (8) A drying process for drying the washed colored particles The production procedure is composed by the above processes. However, an external additive adding process for adding the external additive to the dried colored particles is included in some cases according to necessity. In the above processes, "the colored particle" is the mother particle of the toner and can be used directly when no external additive is added.

When the toner relating to the invention is produced, the resin particles and the colorant particles are firstly associated and fused and then ripened to form core particles. Next, the surface of the core particles are each covered by coagulated and fused with the resin particles added to the core particle dispersion to prepare the core/shell structured colored particles.

The core particles can be prepared through the following processes for example. The wax component is dissolved or dispersed in the polymerizable monomer for forming the resin. The monomer is mechanically dispersed into fine particles and polymerized by the mini-emulsion polymerization method. Thus composite resin particles containing the wax component are formed.

The composite resin particles and the colorant particles formed by the above procedure are subjected to the latermentioned salting out and fusing treatment to form core particles. On the occasion of dissolving the wax component into the polymerizable monomer, the wax component may be dissolved in a dissolved state or melted state.

Each of the production processes is described.

(1) Dissolution/Dispersion Process

This process is one which prepares a solution of a radically polymerizable monomer, mixed with a releasing agent compound, by dissolving the releasing agent compound in the radically polymerizable monomer.

(2) Polymerization Process

In one appropriate example of this polymerization process, a radically polymerizable monomer liquid, containing a dissolved or dispersed wax is added to an aqueous medium containing a surfactant at a concentration being at most its critical micelle concentration (CMC), followed by forming droplets via application of mechanical energy, and subsequently, a polymerization reaction is performed in the droplets via addition of a water-soluble radical polymerization initiators. An oil soluble polymerization initiator may be contained in the droplets. In such a polymerization process, the droplets are formed by a forced emulsifying treatment via application of mechanical energy. Examples of such a method of applying mechanical energy include methods of application of strong agitation or ultrasonic vibration energy using a homomixer, ultrasonic waves, or a Manton-Gaulin homogenizer.

In this polymerization process, resin particles containing a wax and a binding resin are obtained. The resin particles may be not only colored particles but also uncolored particles. The colored resin particles are obtained by polymerizing a monomer composition containing a colorant. Further, in cases that employing the uncolored resin particles, colored particles are obtained by fusing resin particles with colorant particles via addition of a colorant particle dispersion to a resin particle dispersion in an aggregation-fusion process, described below.

The weight average particle diameter (dispersion particle diameter) of the resin particles obtained by the polymerization process is preferably 10 to 1,000 nm, and more preferably 30 to 300 nm. The weight average particle diameter is a value measured by an electrophoresis light scattering photometer "ELS-800" manufactured by Otsuka Electronics Co., Ltd.

(3) Aggregation-Fusion Process

Aggregation-fusion is a process to form aggregated particles by aggregating the resin particles obtained by the polymerization process. It is possible to aggregate and fuse internal additive particles such as wax particles and charge controlling agents, together with the resin particles and the colorant particles in the aggregation-fusion process.

"An aqueous medium" in the aggregation-fusion process refers to a medium, which contains water amounting to at least 50% by weight as the main constituent. Herein, examples of the constituents except water include organic solvents soluble in water such as methanol, ethanol, isopropanol, butanol, acetone, methyl ethyl ketone, and tetrahydrofuran.

The colorant particles are prepared by dispersing a colorant in an aqueous medium. The dispersion treatment of the colorant is carried out in the state in which the concentration of a surfactant in water remains to be at least its critical micelle concentration (CMC). Dispersion apparatus employed for dispersing the colorants is not specifically limited. However, preferred examples thereof include an ultrasonic dispersion apparatus, a mechanical homogenizer, a pressure dispersion apparatus such as a Manton-Gaulin homogenizer, a pressure type homogenizer, a sand grinder, a medium type dispersion apparatus such as a Getzmann mill and a diamond fine mill.

Further, surfactants utilized include the same type of the above surfactant. The colorant particles may be surface-modified. The surface-modification method for the colorant is conducted as follows: the colorant is dispersed in a solvent, and a surface modifier is added to the dispersion, followed by conducting reaction of this system via elevating temperature. After the reaction, the colorant is filtered, and washing filtration is repeated with the same solvent, followed by drying the residue to obtain the colorant (or pigment) having been treated with the surface modifier.

A representative method making the resin particles aggregated and fused is salting-out/fusion method. Salting-out fusion is a process growing the particles to the desired particle diameter via the concurrent processing of aggregation and fusion. The particle growing is terminated by adding an aggregation terminating agent.

A salting-out/fusion method, being a representative aggregation and fusion method, is performed as follows: a salting-out agent, composed of an alkali metal salt, an alkaline earth metal salt, or a trivalent salt, serving as an aggregating agent at a concentration being at least its critical aggregation concentration, is added to water containing fine resin particles and colorant particles, followed by conducting fusion and salting-out concurrently via heating up to at least the glass transition point of the fine resin particles, as well as up to the melting peak temperature of the mixture. Herein, examples of the alkali metal salt and the alkaline earth metal salt as a salting-out agent include lithium, potassium, and sodium as the alkali metal salt, and magnesium, calcium, strontium, and barium as the alkaline earth metal salt. Of these, potassium, sodium, magnesium, calcium, and barium are preferred.

In cases in which aggregation and fusion are carried out via salting-out/fusion, it is preferable to allow the standing duration after the addition of a salting-out agent to be as short as possible. Although the reason is not clear, there occur problems that the aggregation state of particles varies; the particle diameter distribution becomes unstable; and surface properties of a fused toner vary, depending on the standing duration after salting-out. Further, it is necessary to allow the temperature for adding the salting-out agent to be equal to or less than the glass transition point of the fine resin particles at least. The reason is that when the temperature for adding the salting-out agent is at least the glass transition point of the fine resin particles, it is impossible to control the particle diameter, although salting-out/fusion of the fine resin particles rapidly proceeds, resulting in causing such a problem that particles having a large particle diameter are created. Although the temperature range of this addition may be at most the glass transition point of the resin, it is common to be 5-55° C., but preferably 10-45° C.

The salting-out agent is added at a temperature being at most the glass transition point of the fine resin particles, followed by elevating temperature, as soon as possible, up to a temperature being at least the glass transition point of the fine resin particles, as well as being at least the melting peak temperature of the above mixture. It is preferable that the time required for elevating temperature be less than an hour. Further, the rapid temperature elevation is necessary, but it is preferable that the elevating rate be at least 0.25° C./min. The upper limit for the elevating rate is not specifically definite, but it is preferable to be at most 5° C./min due to a problem of the difficulty in controlling the particle diameter since salting-out is carried rapidly due to instantaneous temperature elevation. In this fusion process, associated particles, that is, an aggregated particle dispersion, containing the resin particles and optional particles such as colorant particles, is obtained.

(4) First Ripening Process

This is a process to obtain core particles by control shape of particles via digesting aggregated particles by means of supplying energy to dispersion of aggregated particles prepared in the previous mentioned aggregation-fusion process.

The surface of the core particles, having been formed to have constant and narrow distribution of the particle diameter, is controlled so as to have a smooth but uniform shape by controlling heating temperature in the aggregation-fusion process, specifically, by controlling heating temperature and duration in a first ripening process. Specifically, uniformalization is facilitated by setting heating temperature at a low temperature in the aggregation-fusion process, in which self-fusion process of the particles is controlled, and also while the surface of the core particles is allowed to be of a uniform shape by setting heating temperature at a low temperature, as well as by prolonging the process duration in the first ripening process.

(5) Shell Formation Process

In a shell formation process, a shell resin particle dispersion is added to a core particle dispersion to allow the shell resin particles to aggregate and fuse on the surface of the core particles, and further to coat the surface of the core particles, whereby a core-shell structure is formed.

The shell resin particle dispersion is added to the core particle dispersion, while the temperatures in the aggregation-fusion process and the first ripening process are maintained, and thereafter colored particles, having the surface coated with the shell resin particles, are formed, in which the coating process proceeds slowly over several hours via continuous application of heating and agitation. Herein, the heating and agitation duration is preferably in the range of 1-7 hours, more preferably 3-5 hours.

A shell having a thickness of 100-300 nm is formed on the surface of the core particles by this operation din the shelling process. Growth is terminated by addition of stopping agent such as sodium chloride when the colored particle reaches to predetermined particle diameter.

(6) Second Ripening Process

Heating and agitation of the colored particle dispersion are continued for several hours after the particle diameter of the colored particles reaches the predetermined one during shell formation, the particle growing process is terminated by adding a stopping agent such as sodium chloride in this process. Fusion of shell resin particles adhered onto the surface of the core particles are progressed by continuing the heating and agitation whereby the adhere of the shell resin particles to the surface of the core particles is strengthen in the second ripening process. The colored particles after the shell formation are allowed to adhere to the surface of the core particles, the roundish and moreover uniform colored particles are formed at the same time.

(7) Cooling Process•Solid-Liquid Separation•Washing Process

The core shell colored particle dispersion subjected to the second ripening process is cooled, colored particles are separated from the cooled dispersion, and washing the colored particles to remove surfactant and so on, from the colored particles in this process.

The core shell colored particle dispersion is cooled rapidly. The cooling rate is 1-20° C./min. Methods of the cooling treatment is not critical and may include a method of cooling via providing a cooling medium from the exterior of the reaction vessel, and a method of cooling by directly placing chilled water into the reaction system.

The colored particles are separated from the colored particle dispersion, which has been cooled down to a predetermined temperature in the above process in a solid-liquid separation process. The accumulated substance of the separated colored particles in a wet state is called toner-cake being aggregated as a cake-shape form. The toner cake is subjected to a washing treatment of removing deposits such as the surfactant and the salting-out agent from surface of the colored particles. Separation methods include a centrifugal separation method, a vacuum filtration method carried out employing a Buchner funnel, and a filtration method carried out employing a filter press.

It is preferred to repeat the solid-liquid separation treatment and washing treatment to remove deposit from the colored particles completely.

(8) Drying Process

This process is one in which the washed toner cake is dried to prepare dried colored particles. Examples of driers employed preferably in this process include a spray drier, a vacuum freeze drier, and a vacuum drier, and further the stationary tray drier, transportable tray drier, fluid layer drier, rotary type drier, and stirring type drier may be employed. The moisture in the dried colored particles is preferably at most 5% by weight. In addition, when the dried colored particles are aggregated via weak attractive force among themselves, the aggregates may be pulverized. Herein, mechanical pulverizing apparatuses such as a jet mill, a HENSCHEL mixer, a coffee mill, or a food processor may be employed as a pulverizing method.

Colored particles composing the toner can be obtained by the processes mentioned above. The colored particles may be used as a toner when the external additives are not necessary to add.

(9) External Additive Treatment Process

This process is one in which a toner is prepared, if appropriate, by mixing external additives in the dried colored particles. Mechanical mixers such as a HENSCHEL mixer or a coffee mill may be employed as a mixer for the external additives.

(Materials Composing Toner)

The materials composing toner employable in this invention such as resins, colorants, waxes and external additives are described.

(Resins)

The resins employable in this invention are described. The resins employed in the toner comprises polymer of vinyl monomers not less than 50%, preferably 80% by weight of the whole amount of toner resin, and has a glass transition point of 20-45° C. The resin satisfying these conditions is employable.

The resin can be prepared by polymerizing monomers representative to one or more kinds of vinyl monomers such that shown as (1) to (10) so as to have a glass transition point of 20-45° C. Specific examples of a polymerizable vinyl monomer are below:

(1) Styrene and its Derivatives:

styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene.

(2) Methacrylic Acid Ester Derivatives:

methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate.

(3) Acrylic Acid Ester Derivatives:

methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate.

(4) Olefins:

ethylene, propylene and isobutylene.

(5) vinyl esters:

vinyl propionate, vinyl acetate and vinyl benzoate.

(6) Vinyl Ethers:

vinyl methyl ether and vinyl ethyl ether.

(7) vinyl ketones:

vinyl methyl ketone, vinyl ethyl ketone and vinyl hexyl ketone.

(8) N-Vinyl Compounds:

N-vinyl carbazole, N-vinyl indole and N-vinyl pyrrolidone (9) Other Vinyl Compound Vinyl naphthalene, and vinylpyridine.

(10) Derivatives of Acrylic Acid or Methacrylic Acid:

Acrylonitrile, methacrylonitrile and acrylamide.

Further, it is further preferable to simultaneously employ those having an ionic dissociating group as a polymerizable monomer constituting resins, which are exemplified as ones having a carboxyl group, a sulfonic acid group, and a phosphoric acid group.

Specific examples include acrylic acid, methacrylic acid, maleic acid, itaconic acid, cinnamic acid, fumaric acid, monoalkyl maleate, monoalkyl itaconate, styrene sulfonic acid, allylsulfocinnamic acid, 2-acrylamido-2-methylpropnaesulfnic acid, acid phosphoxyethyl acrylate, and 3 choro-2-acid phosphoxypropyl methacrylate.

Acrylic acid and methacrylic acid are particularly preferable among these.

Further, a cross-linked resin can be obtained using polyfunctional vinyls such as divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

The monomers (1) styrene and its derivatives, (2) methacrylic acid ester derivatives, (3) acrylic acid ester derivatives, and acrylic acid and methacrylic acid are preferably used to form a toner resin in this invention.

Glass transition temperature of the resin can be controlled by selecting the monomers and the proportion is selected. The larger ratio of monomers giving higher Tg, such as styrene, methylmethacrylate and methacrylic acid, makes Tg of the resin higher, and the larger ratio of monomers giving lower Tg, such as propyl acrylate, propylmethacrylate, butylacrylate, 2-ethyhexylacrylate and laurylacrylate, makes Tg of the resin lower The amount of the monomers having an ionic dissociating group is preferably not more than 10 weight %.

(Colorants)

Examples of colorants employed in the toner are listed.

Examples used as a black colorant include carbon blacks such as furnace black, channel black, acetylene black, thermal black, or lamp black, as well as magnetic powders such as magnetite or ferrite.

Colorants for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Colorants for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138.

Colorants for green or cyan include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, and C.I. Pigment Green 7.

These colorants may be used individually or in combinations of at least selected two types. Further, the amount of colorants added is commonly from 1-30% by weight, preferably from 2-20% by weight based on the total toner weight.

Waxes usable for the toner are exemplified.

(1) Long Chain Hydrocarbon Wax

Polyolefin waxes such as polyethylene wax and polypropylene wax; paraffin wax and Sasol wax;

(2) Ester Wax

Trimethylolpropane tribehenate, pentaerythritol tetramyristate, pentaerythritol tetrastearate, pentaerythritol tetrabehenate, pentaerythritol diacetate dibehenate, glycerin tribehenate, 1,18 octadecanediol distearate, tristearyl trimellitate and distearyl maleate.

(3) Amide Wax

Ethylenediaminedibehenylamide and trimellitic acid tristearylamide.

(4) Dialkyl Ketone Wax

Distearyl ketone.

(5) Others

Carnauba wax and montan wax.

The melting point of a wax is commonly from 40-160° C., preferably from 50-120° C., more preferably from 60-90° C. By allowing the melting point as described above, heat-resistant storage properties of the toner are secured, and also stable formation of toner images is carried out in such a manner that no cold offsetting occurs even during low temperature fixing. Further, the wax content in the toner is preferably from 1%-30% by weight, more preferably from 5%-20% by weight.

Incorporation of an external additive results in improved fluidity or electrostatic property or achieves enhanced cleaning ability. The kind of external additives is not critical and examples thereof include inorganic microparticles and organic microparticles, as described below.

There are usable inorganic microparticles and preferred examples thereof include silica, titania, alumina and strontium titanate microparticles. There may optionally be used inorganic microparticles which have been subjected to a hydrophobicization treatment.

Specific examples of silica microparticles include R-805, R-974, R-976, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania microparticles include T-805 and T-604 which are commercially available from Nippon Aerosil Co. Ltd.; MT-100S, MT-100B, MT-500BS, MT-600, MT-600SS, MT-600SSJA-1 which are commercially available from Tayca Corporation; TA-300SI, TA-500, TAF-130, TAF-510 and TAF-510T which as commercially available from Fuji Titanium Industry Co., Ltd.; IT-S, IT-OA, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Kaisha Ltd.

Spherical organic microparticles having a number-average primary particle size of 10 to 2000 nm are usable as organic microparticles. Specifically, there is usable styrene or methyl methacrylate homopolymer or their copolymers.

Such an external additive or lubricant is incorporated preferably in an amount of 0.1 to 10.0% by weight of the total toner. The external additive or lubricant can be incorporated by using mixing devices such as a tabular mixer, a Henschel mixer, a Nauter mixer or a V-shape mixer.

(Developer)

The toner may be used as a toner used for a single-component developer, or a two-component developer.

The toner may be used as a non-magnetic single component developer as itself, or a magnetic single component developer in which magnetic powder having particle size of 0.1 to 0.5 μm is incorporated in the toner particles.

The toner may be used as a two-component developer, in which the toner is mixed with a carrier. Magnetic particles, for example, metals such as iron, ferrite or magnetite and alloys of these metals and aluminum or lead are usable as a carrier, and ferrite particles are specifically preferred.

There may also be used as a coat carrier in which the magnetic particle surface is coated with a covering agent or a dispersion type carrier obtained by dispersing powdery magnetic material in a binder resin. Example of the resin used for coating carrier includes olefin resin, styrene resin, styrene-acryl resin, silicon resin, ester resin and fluorine containing resin. Example of the resin used for dispersing magnetic powder includes styrene-acryl resin, polyester resin, fluorine resin, and phenol resin. The coated carrier coated with styrene-acryl resin is preferable as it inhibits release of external additives or maintains durability.

The average particle size of a carrier is preferably 20 to 100 μm, and more preferably 20 to 80 μm. The volume-average particle size of the carrier can be determined using a laser diffraction type particle size distribution measurement apparatus provided with a wet disperser, HELOS (produced by SYMPATEC Corp.).

The photoreceptor is described.

<<Photoreceptor>>

The photoreceptor is obtained by forming layers including photosensitive layer on a substrate. A photoreceptor having a surface protective layer is preferably used as necessary.

(Substrate)

A substrate, an electric conductive layer, an inter layer, and photosensitive layers comprising a charge generation layer and charge transfer layer is described.

(Substrate)

A conductive support to be used in a photoreceptor of the present invention has a sheet shape or a cylindrical shape.

A conductive support in a cylindrical shape in the present invention means one that is necessary for endless forming of images by rotation, and it is preferably a conductive support having straightness not greater than 0.1 mm and a fluctuation not greater than 0.1 mm for satisfactory image forming.

Examples of materials used for the conductive support include, for example, metal drums of aluminum or nickel; plastic drums evaporated with aluminum, tin oxide or indium oxide and paper or plastic drums coated with a conductive material. A conductive support preferably has a specific resistance of $10^3$ Ocm or less at ambient temperature.

The conductive support may have a sealed alumite film formed on the surface thereof. Alumite processing is usually performed in an acid bath of, for example, chromic acid, sulfuric acid, oxalic acid, phosphoric acid, boric acid and sulfamic acid, wherein anodizing in sulfuric acid gives the most preferable result. In the case of anodizing in sulfuric acid, anodizing is preferably performed with a sulfuric acid concentration ranging from 100 to 200 g/l and aluminum ion concentration ranging from 1 to 10 g/l at a temperature of around 20° C., and with an applied voltage of about 20 V, however, not specifically limited. The average film thickness of the anodized layer is preferably 20 μm or less in usual cases, and it is specifically preferable to be 10 μm or less.

(Electric Conductive Layer)

The photoreceptor may have an electric conductive layer on a substrate. The electric conductive layer is fundamentally composed of a binder resin and electric conductive pigment. A thickness of the layer is preferably 0.3-20 μm, more preferably 1-1 μm.

A thermosetting resin, which is not dissolved by a solvent used in forming the inter layer, is preferably employed as the binder resin for this layer to maintain uniform coat layer after coating the interlayer.

Interlayer

An interlayer, functioning as a barrier, may be provided between the electrically conductive support and the photosensitive layer. Listed as materials of said sublayer are polyamide resins, vinyl chloride resins, vinyl acetate resins, and copolymer resins comprising at least two recurring units of these resins. Polyamide resins are preferably used, which can minimize the increase residual potential with repeated exposures. Thickness of the layer employing these resins is preferably 0.01-1 μm.

Listed as the sublayer, which is most preferably employed, is those comprised of thermosetting metal resin which is subjected to thermal hardening employing organic metal compound such as silane coupling agent, titanium coupling agent, and the like. The thickness of the interlayer comprised of said hardenable metal resins is preferably between 0.1 and 2 μm.

An interlayer of another embodiment is that composed of a binder resin and inorganic particles dispersed in the resin. An average particle diameter of the inorganic particles is preferably 0.01-1 μm. An interlayer containing surface treated N-type semiconductive particles dispersed in a resin is particularly preferable. An example is composed of titanium oxide having an average particle diameter of 0.01-1 μm surface treated with silica/alumina treatment or treated with silane compound dispersed in polyamide resin. A thickness of the interlayer is preferably 1-20 μm.

(Charge Generating Layer)

The charge generating layer comprises charge generating materials (CGM). As to other materials, if desired, binder resins and other additives may be incorporated.

The charge generating materials employed may be, for example, phthalocyanine pigments, azo pigments, perylene pigments, azulenium pigments, and the like. Of these, CGMs, which are capable of minimizing an increase in residual potential under repeated use, are those which comprise a three-dimensional electrical potential structure capable of forming stable agglomerated structure among a plurality of molecules. Specifically listed are CGMs of phthalocyanine pigments and perylene pigments having a specific crystalline structure. For instance, titanyl phthalocyanine having a maximum peak at 27.2° of Bragg angle 2θ with respect to a Cu—Kα line, benzimidazole perylene having a maximum peak at 12.4° of said Bragg 2θ, and the like, result in minimum degradation after repeated use, and can minimize the increase in residual potential.

When in the charge generating layer, binders are employed as the dispersion media of CGM, employed as binders may be any of the resins known in the art. Listed as the most preferable resins are formal resins, butyral resins, silicon resins, silicon modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As other materials, if desired, incorporated may be additives such as antioxidants and the like.

Employed as charge transfer materials (CTM) may be triphenylamine derivatives, hydrazone compounds, styryl compounds, benzidine compounds, butadiene compounds, and the like. These charge transport materials are usually dissolved in appropriate binder resins and are then subjected to film formation. Thickness of the CTM is preferably 10-40 μm.

Resins employed in the charge transport layer are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicon resins, melamine resins, and copolymers comprising at least two repeating units of these resins, and other than these insulating resins, high molecular organic semiconductors such as poly-N-vinylcarbazole.

Polycarbonate resins are most preferable as CTL binders. Polycarbonate resins are most preferred because of improved dispersibility of CTM as well as electrophotographic properties. The ratio of binder resins to charge transport materials is preferably between 10 and 200 weight parts per 100 weight parts of the binder resins.

It is preferred to incorporate an anti-oxidant in the CTL. The anti-oxidant is a substance which prevents or restrains function of oxygen to auto-oxidation substance in the photoreceptor or on the surface thereof under circumstances of light, heat, electric discharge and so on. Example of the anti-oxidant includes 2,6-di tert-butyl-4-methylphenol.

In some cases, the surface of the photoreceptor is the charge transfer layer and a surface protection layer may be provided thereon. The role of the surface protection layer is to hold the hardness of the surface of photoreceptor and to prevent the contamination of the photoreceptor surface caused by adhesion of foreign maters. However, there is also an organic photoreceptor designed so that the outermost layer thereof performs such the role even though any surface protection layer is not provided. The fatty acid metal salt is supplied and spread onto the surface of such the photoreceptors.

Organic or inorganic filler is contained in the surface protection layer. As the filler to be contained in the surface protection layer, powder of silica, alumina, titanium oxide and strontium titanate are preferable.

Identification and qualification can be carried out by X-ray photoelectron spectroscopy (XPS) or energy dispersive X-ray spectroscopy.

When the filler is a metal oxide particle, one strengthened by sintering is preferred. For instance, alumina strengthened by sintering is preferred as alumina to be subjected to plural times of surface treatment since hydrophobilizing treatment to alumina without strengthening by sintering is difficultly performed. As the strengthened alumina by sintering, one sintered at a temperature of 500° C. or more, and preferably 1,000° C. or more, is preferably used. The sintering time is preferably not less than 5 hours and more preferably not less than 10 hours. Functional groups such as hydroxyl group being on the alumina particles are decomposed to form aluminum oxide by the sintering under the above conditions. As a result of that, the specific surface area of the alumina particle is reduced and the surface treatment can be effectively carried out when the alumina particle is subjected to the hydrophobilizing treatment by a silane compound.

Fine particles having a number average primary particle diameter of from 1 to 300 nm, particularly preferably 3 to 150 nm, are used. The number average primary particle diameter is a value of average diameter in Fere direction which is determined by that the fine particles are observed by a transmission type electronmicroscope at a magnification of 10,000 times, and 100 primary particles are randomly selected from them and subjected to image analysis. When the number average primary particle diameter is not less than 1 nm, the filler can be uniformly dispersed in the surface layer and coagulated particles are difficultly formed. As a result of that, increasing in the remaining potential, lowering in the image density, burring in the image and uniformity of the image caused by transferring memory are difficultly caused. On the other hand, image burring and filming are difficultly caused when the filler having a number average primary particle diameter of 300 nm or less is used because large irregularity on the surface of the photoreceptor is not caused and adhesion of active gas such as ozone and $NO_x$ at the irregularity is made small. Moreover, the filler having a number average primary particle diameter of not more than 300 nm is difficultly precipitated in the dispersion and occurrence of coagulated particles is small.

In the invention, the filler is preferably treated on the surface thereof. The surface treatment of the filler can be carried out by a wet method. For instance, the filler is dispersed in water to form aqueous slurry and the resultant slurry is mixed with a water-soluble silicate or a water-soluble aluminum compound. When sodium silicate is used as the water soluble-silicate, neutralization can be carried out by an acid such as sulfuric acid, nitric acid and hydrochloric acid. When aluminum sulfate is used as the water-soluble aluminum compound, neutralization can be performed by an alkali such as sodium hydroxide and potassium hydroxide. In the surface treatment by a reactive organic silicone compound, the filler is mixed with a liquid composed of an organic solvent or water in which the reactive organic silicone compound is dissolved or dispersed and the resultant mixture is stirred for about 1 hour. The mixture is further subjected to heating treatment sometimes, and then the filler is filtered and dried. Thus filer covered with the organic silicone compound on the surface can be obtained. In the surface treatment by a fluorine compound, a fluorine-containing organic silicone compound is dissolved or dispersed in an organic solvent or water and resultant dispersion is mixed with the metal oxide particles and stirred for a time of from several minutes to about 1 hour. The mixture is further subjected to heating treatment sometimes. Then the particles are filtered and dried to obtain particles covered with the fluorine compound. Among the alumina surface treated by plural times of the invention, one treated for improving the dispersing ability is used in certain layer for improving the stability of the coating liquid containing such the particles and one treated by silicone oil or silicone resin for improving the slipping ability and surface property is used in another layer for improving the slipping ability and the surface property.

As a preferable example of the plural times-surface treatment relating to the invention, oxide particles firstly treated by a halogenized silane compound and finally treated by a silazane compound on the surface thereof is preferred.

The oxide particle primarily treated by silicone oil and finally treated by silazane on the surface thereof is also preferable. For instance, the oxide particles improved in the hydrophobicity and its distribution can be obtained by that the oxide particles are primarily treated by a halogenized silane type or a silicone oil type treating agent and the treated powder is crushed and secondarily treated by an alkylsilazane type treating agent.

The primary treatment by the silicone oil type treating agent and the secondary treatment by the alkylsilazane type treating agent after the crushing may be either a dry treatment or wet treatment. The hydrophobicity and its distribution are not improved and the object of the invention cannot be attained when the order of the primary surface treatment and the secondary surface treatment is different or the kind and amount of the treating agent or the treating method is unsuitable. Particularly, the surface treatment is released off with passing of time and the distribution of hydrophobicity tens to be extended when the final treatment is carried out by a treating agent other than the silazane compound.

The hydrophobicity and its distribution of the filler can be improved by such the plural time surface treatment, and the transfer of the lubricant from the carrier can be effectively performed so that a high quality image without internal image lacking can be obtained.

In the surface layer, a binder resin assisting the dispersibility of the filer is contained. As such the binder resin, polycarbonate or polyallylate is preferable. The molecular weight of the polycarbonate or polyallylate is preferably from 10,000 to 100,000.

The ratio of the inorganic particles in the surface layer is preferably from 5 to 50 parts by weight to 100 parts by weight of the binder resin Particularly preferable ratio is from 6 to 30 parts by weight. When the ratio is less than 5 parts by weight, the wearing of the surface layer is made larger and the half tone image tends to be caused by occurrence of scratches. When the ratio is more than 50 parts by weight, the surface layer is made brittle and cracks tend to be caused.

The surface layer preferably contains a charge transfer material.

Positive hole transfer type (P-type) charge transfer material (CTM) is preferably used. For example, a triphenylamine derivative, hydrazone compound, styryl compound, benzyl compound and butadiene compound can be used. These charge transfer materials are usually dissolved in a suitable binder resin to form the layer.

The weight ratio of the binder resin and the charge transfer material in the surface layer is preferably from 30 to 200, and more preferably from 50 to 150, parts by weight of the charge transfer material to 100 parts by weight of the binder resin.

EXAMPLES

The invention is concretely described below referring examples but the embodiment of the invention is not limited to the examples.

<<Preparation of Toner>>

A toner was prepared by the following method.

<Preparation of Resin Particle for Core Particle>

<Preparation of Resin Particle 1 for Core Particle>

(1) First Step Polymerization

The following compounds were charged and mixed in a reaction vessel on which a stirrer, thermal sensor, cooling tube and nitrogen introducing device were attached.

| | |
|---|---|
| Styrene | 110.9 parts by weight |
| n-butyl acrylate | 52.8 parts by weight |
| Methacrylic acid | 12.3 parts by weight |

To the resultant mixture, 93.8 parts by weight of paraffin wax HNP-57, manufactured by Nippon Seiro Co., Ltd., was added and dissolved by heating at 80° C. to prepare a polymerizable monomer solution.

A surfactant solution was prepared by dissolving 2.9 parts by weight of sodium polyoxyethylene(2)dodecylether-Sulfate in 1,340 parts by weight of deionized water. The surfactant solution was heated by 80° C. and the above polymerizable monomer solution was poured into it, and the polymerizable monomer solution was dispersed for 2 hours by a mechanical disperser having a circulation pass, CLEARMIX manufactured by M-Technique Co, Ltd., to prepare a dispersion of emulsified particles (oil droplets) having an average particle diameter of 245 nm.

After that, 1460 parts by weight of deionized water was added and then an initiator solution prepared by dissolving 6 parts by weight of a polymerization initiator (potassium persulfate) in 142 parts by weight of deionized water and 1.8 parts by weight of n-octylmercaptan was added and the temperature was adjusted to 80° C. Polymerization (first step of polymerization) was performed by heating and stirring the system to prepare resin particles which were referred to as Resin Particle C1.

(2) Second Step Polymerization (Formation of Outer Layer)

To the above Resin Particle C1, an initiator solution prepared by dissolving 5.1 parts by weight of potassium persulfate in 107 parts by weight of deionized water was added and a monomer mixture composed of the following polymerizable monomers was dropped spending 1 hour under a temperature condition of 80° C.

| | |
|---|---|
| Styrene | 282.2 parts by weight |
| n-butyl acrylate | 134.4 parts by weight |
| Methacrylic acid | 31.4 parts by weight |
| n-octylmercaptan | 4.93 parts by weight |

After completion of the dropping, the system was heated and stirred for 2 hours for carrying out the second step of polymerization (formation of outer layer). And then the system was cooled by 28° C. to obtain Core Rein Particle 1.

The weight average molecular weight, weight average particle diameter and glass transition point of Core Resin Particle 1 were 21,300, 180 nm and 39° C., respectively.

(Preparation of Core Resin Particle 2)

Core Rein Particle 2 was prepared in the same manner as in Resin Core Particle 1 except that the amounts of the polymerizable monomers in the first polymerization step were changed as follows,

| | |
|---|---|
| Styrene | 90.8 parts by weight |
| n-butyl acrylate | 72.7 parts by weight |
| Methacrylic acid | 12.3 parts by weight |

and the amounts of the polymerizable monomers in the second polymerization step were changed as follows

| | |
|---|---|
| Styrene | 274.1 parts by weight |
| n-butyl acrylate | 168.6 parts by weight |
| Methacrylic acid | 5.2 parts by weight |

The weight average molecular weight, weight average particle diameter and glass transition point of Core Resin Particle 2 were 22,000, 180 nm and 20.1° C., respectively.

(Preparation of Core Resin Particle 3)

Core Rein Particle 3 was prepared in the same manner as in Core Resin Particle 1 except that the amounts of the polymerizable monomers in the first polymerization step were changed as follows,

| | |
|---|---|
| Styrene | 115.3 parts by weight |
| n-butyl acrylate | 48.4 parts by weight |
| Methacrylic acid | 12.3 parts by weight |

and the amounts of the polymerizable monomers in the second polymerization step were changed as follows.

| | |
|---|---|
| Styrene | 293.4 parts by weight |
| n-butyl acrylate | 123.2 parts by weight |
| Methacrylic acid | 31.4 parts by weight |

The weight average molecular weight, weight average particle diameter and glass transition point of Core Resin Particle 3 were 22,500, 180 nm and 44° C., respectively.

(Preparation of Core Resin Particle 4)

Core Rein Particle 4 was prepared in the same manner as in Core Resin Particle 1 except that the amounts of the polymerizable monomers in the first polymerization step were changed as follows,

| | |
|---|---|
| Styrene | 103.5 parts by weight |
| n-butyl acrylate | 70.4 parts by weight |
| Methacrylic acid | 2.1 parts by weight |

and the amounts of the polymerizable monomers in the second polymerization step were changed as follows.

| | |
|---|---|
| Styrene | 263.4 parts by weight |
| n-butyl acrylate | 179.2 parts by weight |
| Methacrylic acid | 5.4 parts by weight |

The weight average molecular weight, weight average particle diameter and glass transition point of Core Resin Particle 4 were 22,500, 180 nm and 18° C., respectively.

(Preparation of Core Resin Particle 5)

Core Rein Particle 5 was prepared in the same manner as in Core Resin Particle 1 except that the amounts of the polymerizable monomers in the first polymerization step were changed as follows,

| | |
|---|---|
| Styrene | 119.7 parts by weight |
| n-butyl acrylate | 44.0 parts by weight |
| Methacrylic acid | 12.3 parts by weight |

and the amounts of the polymerizable monomers in the second polymerization step were changed as follows.

| | |
|---|---|
| Styrene | 304.6 parts by weight |
| n-butyl acrylate | 112.0 parts by weight |
| Methacrylic acid | 31.4 parts by weight |

The weight average molecular weight, weight average particle diameter and glass transition point of Core Resin Particle 5 were 22,500, 180 nm and 49° C., respectively.

(Preparation of Resin Particle for Shell)

Into a reaction vessel on which a stirrer, thermal sensor, cooling tube and nitrogen introducing device were attached, a surfactant solution composed of 2.0 parts by weight of sodium polyoxyethylene(2)dodecylether sulfate and 3,000 parts by weight of deionized water was charged and the internal temperature was raised by 80° C. while stirring at a stirring rate of 230 rpm under nitrogen gas stream.

An initiator solution prepared by dissolving 10 parts by weight of a polymerization initiator (potassium persulfate) in 200 parts by weight of deionized water was added to the surfactant solution and a polymerizable monomer solution composed of a mixture of the following polymerizable monomers was dropped into the surfactant solution spending 3 hours.

| | |
|---|---|
| Styrene | 528 parts by weight |
| n-butyl acrylate | 176 parts by weight |
| Methacrylic acid | 120 parts by weight |
| n-octylmercaptan | 22 parts by weight |

Completion of the dropping of the polymerizable monomer solution, the system was heated and stirred for 1 hour at 80° C. for progressing polymerization to obtain rein particles. The particles were referred to as Resin Particle for Shell.

The weight average molecular weight, weight average particle diameter and glass transition point of Resin Particle for Shell were 12,000, 120 nm and 53° C., respectively.

(Preparation of Colorant Dispersion)

(Preparation of Colorant Dispersion Bk1)

To 900 parts by weight of 10 weight-percent solution of sodium dodecylsulfate, 100 parts by weight of a colorant Regal 330R, manufactured by Cabot Corp., was gradually added while stirring and dispersed by a stirring apparatus CLEARMIX, manufactured by M-Technique Co., Ltd., to prepare a dispersion of the colorant particles. The dispersion was referred to as Colorant Dispersion Bk1. The average dispersed particle diameter of the colorant particles in the dispersion measured by a dynamic light scattering particle size analyzer Microtrac UPA150, manufactured by Nikkiso Co., Ltd., was 150 nm.

(Preparation of Colorant Dispersion C1)

A colorant dispersion was prepared in the same manner as in Colorant Dispersion Bk1 except that 420 parts by weight of the colorant Regal 330R, manufactured by Cabot Corp., was replace by 210 parts by weight of C. I. Pigment Blue 15:3. The dispersion was referred to as Colorant Dispersion C1. The average dispersed particle diameter of the colorant particles in the dispersion measured by a dynamic light scattering particle size analyzer MICROTRAC UPA150, manufactured by Nikkiso Co., Ltd., was 150 nm.

(Preparation of Colorant Dispersion M1)

A colorant dispersion was prepared in the same manner as in Colorant Dispersion Bk1 except that 420 parts by weight of the colorant Regal 330R, manufactured by Cabot Corp., was replace by 357 parts by weight of C. I. Pigment Red 122. The dispersion was referred to as Colorant Dispersion M1. The average dispersed particle diameter of the colorant particles in the dispersion measured by a dynamic light scattering particle size analyzer Microtrac UPA150, manufactured by Nikkiso Co., Ltd., was 150 nm.

(Preparation of Colorant Dispersion Y1)

A colorant dispersion was prepared in the same manner as in Colorant Dispersion Bk1 except that 420 parts by weight of the colorant Regal 330R, manufactured by Cabot Corp., was replace by 378 parts by weight of C. I. Pigment Yellow 74. The dispersion was referred to as Colorant Dispersion Y1. The average dispersed particle diameter of the colorant particles in the dispersion measured by a dynamic light scattering particle size analyzer Microtrac UPA150, manufactured by Nikkiso Co., Ltd., was 150 nm.

(Preparation of Colored Particle Bk1)

(Salt Out/Fusion (Association/Fusion) Process)

(Formation of Core)

Into a reaction vessel on which a thermal sensor, cooling tube and nitrogen introducing device were attached, 420.7 parts by weight in terms of solid component of Core Resin Particle 1, 900 parts by weight of deionized water and 200 parts by weight of Colorant Particle Dispersion Bk1 were charged and stirred. The temperature of the contents was adjusted at 30° C. and the pH of the liquid was adjusted to 9 by adding a 5 mole/L solution of sodium hydroxide solution.

Then an aqueous solution prepared by dissolving 2 parts by weight of magnesium chloride hexahydrate in 1,000 parts by weight of deionized water was added spending 10 minutes at 30° C. After standing for 3 minutes, the system was heated by 65° C. spending 60 minutes. In such the situation, the diameter of the associated particle was measured by Coulter Multisizer 3, manufactured by Coulter Inc., and an aqueous solution composed of 40.2 parts by weight of sodium chloride and 1,000 parts by weight of deionized water was added for stopping growth of the particles when the volume based median diameter of the particles ($D_{50}$) becomes 5.5 μm. Furthermore, the ripening was carried out for continuing fusion by heating and stirring for 1 hour at a liquid temperature of 70° C. to form Core 1.

The circular degree of Core 1 measured by FPIA-2100, manufactured by Sysmex Co., Ltd., was 0.930.

(Formation of Shell Layer (Shelling Process))

After that, 50 parts by weight in terms of solid component of Resin Particles for Shell was added at 65° C. and an aqueous solution composed of 2 parts by weight of magnesium chloride hexahydrate and 1,000 parts by weight of deionized water was further added spending 10 minutes and the temperature was raised by 70° C. (shell forming temperature). The system was further stirred for 1 hour for fusing Resin Particles for Shell onto the Core 1. Then ripening was conducted at 75° C. for 20 min to form a shell layer.

To the system, 40.2 parts by weight of sodium chloride was added and the system was cooled by 30° C. at a cooling rate of 8° C./minute. Thus an aqueous solution containing colored particles was obtained.

(Washing and Drying Processes)

The solid component was separated from the aqueous solution containing colored particles by a basket type centrifuge Mark III Model No. 60×40, manufactured by Matsumoto Machine MFG. Co., Ltd., to form a wet cake of colored particles. The wet cake was washed by water using the centrifuge until the electroconductivity of the filtrate becomes 5 μS/cm. After that, the cake was transferred to Flash Jet Dryer, manufactured by Seishin Enterprise Co., Ltd., and dried until the moisture content becomes 0.5% by weight to prepare Colored Particle Bk1. Thus obtained Colored Particle Bk1 had core/shell structure and the volume based median diameter ($D_{50}$) and Tg thereof were 6.0 μm and 39.5° C., respectively.

(Preparation of Colored Particle Bk2)

Colored Particle Bk2 was prepared in the same manner as in Colored Particle Bk1 except that the resin particle for core to be used for forming the core was replaced by Core Resin Particle 2. The volume based median diameter ($D_{50}$) and Tg of this particle were each 6.0 μm and 20.5° C., respectively.

(Preparation of Colored Particle Bk3)

Colored Particle Bk3 was prepared in the same manner as in Colored Particle Bk1 except that the resin particle for core to be used for forming the core was replaced by Core Resin Particle 3. The volume based median diameter ($D_{50}$) and Tg of this particle were each 6.0 μm and 44.5° C., respectively.

(Preparation of Colored Particle Bk4)

Colored Particle Bk4 was prepared in the same manner as in Colored Particle Bk1 except that the resin particle for core to be used for forming the core was replaced by Core Resin Particle 4. The volume based median diameter ($D_{50}$) and Tg of this particle were each 6.3 μm and 19.0° C., respectively.

(Preparation of Colored Particle Bk5)

Colored Particle Bk5 was prepared in the same manner as in Colored Particle Bk1 except that the resin particle for core to be used for forming the core was replaced by Core Resin Particle 5. The volume based median diameter ($D_{50}$) and Tg of this particle were each 6.1 μm and 49.5° C., respectively.

(Preparation of Toner Bk1)

To 100 parts by weight of the above-prepared Colored Particle Bk1, 3.5 parts by weight of hydrophobic silica fine particles having a number average primary particle diameter of 80 nm and 0.6% by weight of hydrophobic titania fine particles having a number average primary particle diameter of 10 nm were added and mixed for 25 minutes at a circumference speed of 35 m/sec by a Henschel mixer, manufactured by Mitsui Miike Kakoki Co., Ltd., to prepare Toner Bk1. The glass transition point of Toner Bk1 was 39.5° C. which was the same as that of Colored Particle Bk1.

(Preparation of Toner Bk2)

Toner Bk2 was prepared by the same manner as in Toner Bk1 except that Colored Particle Bk1 used in the preparation of Toner Bk1 was replaced by Colored Particle Bk2. The glass transition point of Toner Bk2 was 39.5° C. which was the same as that of Colored Particle Bk2.

(Preparation of Toner Bk3)

Toner Bk3 was prepared by the same manner as in Toner Bk1 except that Colored Particle Bk1 used in the preparation of Toner Bk1 was replaced by Colored Particle Bk3. The glass transition point of Toner Bk3 was 44.5° C. which was the same as that of Colored Particle Bk3.

(Preparation of Toner Bk4)

Toner Bk4 was prepared by the same manner as in Toner Bk1 except that Colored Particle Bk1 used in the preparation of Toner Bk1 was replaced by Colored Particle Bk4. The glass transition point of Toner Bk4 was 19.0° C. which was the same as that of Colored Particle Bk4.

(Preparation of Toner Bk5)

Toner Bk5 was prepared by the same manner as in Toner Bk1 except that Colored Particle Bk1 used in the preparation of Toner Bk1 was replaced by Colored Particle Bk5. The glass transition point of Toner Bk5 was 49.5° C. which was the same as that of Colored Particle Bk5.

(Preparation of Toners C1 to C5)

Toners C1 to C5 were prepared in the same manner as in Toners Bk1 to Bk5 except that Colorant Dispersions Bk1 to Bk5 used in Toners Bk1 to Bk5 were each replaced by Colorant Dispersions C1 to C5, respectively.

(Preparation of Toners M1 to M5)

Toners M1 to M5 were prepared in the same manner as in Toners Bk1 to Bk5 except that Colorant Dispersions Bk1 to Bk5 used in Toners Bk1 to Bk5 were each replaced by Colorant Dispersions M1 to M5, respectively.

(Preparation of Toners Y1 to Y5)

Toners Y1 to Y5 were prepared in the same manner as in Toners Bk1 to Bk5 except that Colorant Dispersions Bk1 to Bk5 used in Toners Bk1 to Bk5 were each replaced by Colorant Dispersions M1 to M5, respectively.

<<Preparation of Developer>>

Silicone resin coated ferrite carrier having a volume average median diameter ($D_{50}$) of 60 nm was mixed with each of the above toners to prepare Developers Bk1 to Bk5, C1 to C5, M1 to M5 and Y1 to Y5 each having a toner concentration of 6% by weight.

<<Preparation of Photoreceptor>>

The photoreceptor was prepared as follows.

<Substrate>

An aluminum drum treated by compax processing was prepared as the substrate.

<Intermediate Layer>

The following composition was dissolver to prepare an intermediate layer coating liquid. The coating liquid was coated on the substrate by dip coating to form an intermediate coating layer and then dried for 30 minutes at 100° C. Thus an intermediate layer having a thickness of 1.0 μm was formed.

| | |
|---|---|
| Ethylene-vinyl acetate type copolymer ELVAX 4260, (DuPont Mitsui Polychemicals Co., Ltd.) | 50 parts by weight |
| Toluene/n-butyl alcohol (5:1 in weight ratio) | 2,000 parts by weight |

<Charge Generation Layer>

A charge generation layer coating liquid was prepared by dispersing the following composition for 17 hours by a sand mill. The charge generation coating liquid was coated on the intermediate layer by dip coating to form a charge generation layer. Then the layer was dried for 30 minutes at 100° C. Thus a charge generation layer having a thickness of 1.5 μm was formed.

| | |
|---|---|
| Titanylphthalocyanine CGM-1 (oxytitaniumphthalocyanine having high peaks at 9.5°, 15.0°, 24.1° and 27.3° of Bragg angle (2θ ± 0.2°) in CuKα characteristic X-ray diffraction) | 100 parts by weight |
| Silicone resin KR-5240 (Shin-Etsu Chemical Co., Ltd.) | 100 parts by weight |
| t-butyl acetate | 1,000 parts by weight |

<Charge Transfer Layer>

A charge transfer layer coating liquid was prepared by dissolving the following composition. The charge transfer coating liquid was coated on the charge generation layer by dip coating to form a charge transfer layer. Then the layer was dried for 60 minutes at 110° C. Thus a charge transfer layer having a thickness of 23 μm was formed.

| | |
|---|---|
| CTM | 500 parts by weight |
| Polycarbonate Z-200 (Mitsubishi Gas Chemical Co., Inc.) | 560 parts by weight |
| Dioxolan (b.p. 74-75° C.) | 2,800 parts by weight |
| Methylphenyl silicone oil KF-54 (Shin-Etsu Chemical Co., Inc.) | 100 ppm to entire solid ingredient |

CTM-1

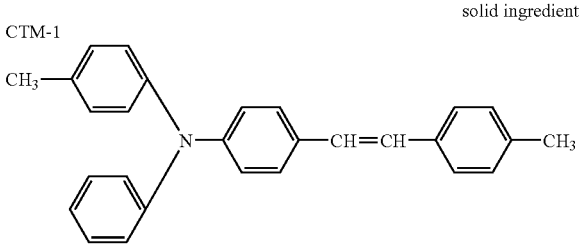

<Surface protection layer 1>

| | |
|---|---|
| Filler: Silica particle (silica having an average primary particle diameter of 50 nm primarily treated by dimethyldichlorosilane and secondarily treated by hexamethyldisilazane on the surface) | 30 parts by weight |
| Charge transfer material (N-(methylphenyl)-N-[4-(β-phenylstyryl)phenyl]-p-toluidine) | 150 parts by weight |
| Polycarbonate Z300 (Mitsubishi Gas Chemical Co., Inc.) | 300 parts by weight |
| Antioxidant IRGANOX 1010 (Nihon Ciba-Geigy K.K.) | 12 parts by weight |
| Tetrahydrofuran | 2,800 parts by weight |
| Silicone oil KF-54 (Shin-Etsu Chemical Co., Ltd.) | 4 parts by weight |

The above components were dispersed and dissolved to prepare a surface protective layer coating liquid. The coating liquid was coated on the charge transfer layer by a circular slide hopper coating machine and dried for 70 minutes at 110° C. to form Surface Protection Layer 1. Thus Photoreceptor 1 was prepared.

<<Preparation of Fatty Acid Metal Salt Block>>

The following fatty acid metal salt block was prepared.

(Preparation of Zinc Stearate Block)

Zinc stearate was melted by heating and formed into a stick-shaped block having a size of width of 8 mm, height of 5 mm and length of 332 mm.

(Preparation of Aluminum Stearate Block)

Aluminum stearate was melted by heating and formed into a stick-shaped block having a size of width of 8 mm, height of 5 mm and length of 332 mm.

(Preparation of Calcium Stearate Block)

Calcium stearate was melted by heating and formed into a stick-shaped block having a size of width of 8 mm, height of 5 mm and length of 332 mm.

(Preparation of Magnesium Stearate Block)

Magnesium stearate was melted by heating and formed into a stick-shaped block having a size of width of 8 mm, height of 5 mm and length of 332 mm.

<<Preparation of Cleaning Blade>>

A counter type cleaning blade for cleaning the toner remaining on the photoreceptor surface was prepared.

Concretely, a cleaning blade made from urethane rubber having a thickness of 2 mm, free length of 9 mm and length of 340 mm was prepared.

<<Preparation of Supplying Member>>

(Preparation of Brush)

A brush was prepared by using fibers having a thickness of 30 deniers as a member for supplying the fatty acid metal salt to the photoreceptor surface.

<Preparation of Fatty Acid Metal Salt Block to be Directly Contacted>

A fatty acid metal salt block attaché on a holder was prepared as a member for supplying the fatty acid metal salt onto the photoreceptor surface.

<<Preparation of Spreading Member>>

A trail type spreading blade was prepared for spreading the fatty acid metal salt supplied on the photoreceptor surface.

Concretely, a spreading blade made from urethane rubber having a thickness of 1.7 mm, free length of 12 mm and length of 340 mm was prepared.

<<Apparatus for Evaluation>>

As an apparatus to be used for evaluation, an image forming apparatus available on the market bizhub PRO C6500, manufactured by Konica Minolta Business Technologies Inc., was prepared which is modified by installing the above prepared cleaning blade, supplying member and spreading member. A transfer roller was used as the transfer means in the image forming apparatus.

Installing Condition of Cleaning Blade

Attaching angle: 20°

Attaching pressure: 30 N/m

Free length: 10 mm

Installing condition of supplying member and fatty acid metal salt supplying amount were as follows.

Digging depth: 0.6 mm

Supplying amount: The amount was set at 0.1 mg/m$^2$, 0.3 mg/m$^2$ or 0.5 mg/m$^2$ by controlling the rotating number of the brush.

Installing Condition of Spreading Blade

Touching angle: 1700

Touching pressure: 15 N/m

Free length: 10 mm

The above prepared toner and the photoreceptor were charged into the above modified image forming apparatus and the supplying amount of the fatty acid metal salt was set as above and printing on 200,000 sheets of A4 size paper was performed under ordinary temperature and humidity (20° C., 50% RH).

Toner number, fatty acid metal salt, cleaning means, supplying means and supplying amount, spreading means and order of the process are listed in Table 1.

TABLE 1

| | Toner No. | Fatty acid metal salt | Cleaning means (1) | Supplying means (2) Tool | Supplying means (2) Supplying amount (mg/m$^2$) | Spreading means (3) | Order of processing |
|---|---|---|---|---|---|---|---|
| Example 1 | 1 | Zinc stearate | *1 | Brush | 0.3 | *2 | (1) → (2) → (3) |
| Example 2 | 2 | Zinc stearate | *1 | Brush | 0.3 | *2 | (1) → (2) → (3) |
| Example 3 | 3 | Zinc stearate | *1 | Brush | 0.3 | *2 | (1) → (2) → (3) |
| Example 4 | 1 | Aluminum stearate | *1 | Brush | 0.3 | *2 | (1) → (2) → (3) |
| Example 5 | 1 | calcium stearate | *1 | Brush | 0.3 | *2 | (1) → (2) → (3) |
| Example 6 | 1 | Magnesium stearate | *1 | Brush | 0.3 | *2 | (1) → (2) → (3) |
| Example 7 | 1 | Zinc stearate | *1 | Directly contacted | 0.3 | *2 | (1) → (2) → (3) |
| Example 8 | 1 | Zinc stearate | *1 | Brush | 0.1 | *2 | (1) → (2) → (3) |
| Example 9 | 1 | Zinc stearate | *1 | Brush | 0.5 | *2 | (1) → (2) → (3) |
| Comp. 1 | 4 | Zinc stearate | *1 | Brush | 0.3 | *2 | (1) → (2) → (3) |
| Comp. 2 | 5 | Zinc stearate | *1 | Brush | 0.3 | *2 | (1) → (2) → (3) |
| Comp. 3 | 2 | None (Carnauba wax) | *1 | — | — | *2 | (1) → (2) → (3) |
| Comp. 4 | 1 | Zinc stearate | *2 | Brush | 0.3 | *2 | (1) → (2) → (3) |
| Comp. 5 | 1 | Zinc stearate | *1 | Brush | 0.3 | *1 | (1) → (2) → (3) |
| Comp. 6 | 1 | Zinc stearate | *1 | Brush | 0.3 | *2 | (1) → (2) → (3) |
| Comp. 7 | 1 | Zinc stearate | *1 | Brush | 0.3 | — | (1) → (2) |

*1: Counter type blade,

*2: Trail type blade,

Comp.: Comparative example

<Evaluation>

(Fixing Ability at Low Temperature)

The fixing ability at low temperature was evaluated as follows. The surface temperature measured at the center portion of the seamless belt in the evaluation apparatus was set at every 5° C. within the range of from 90 to 150° C., and an A4 size sheet having a black belt-shaped solid image with 5 mm width in the vertical direction to the conveying direction was fixed while conveying in the length direction. After that, an A4 size sheet having a belt-shaped black solid image with a width of 5 mm and a halftone image with a width of 20 mm in the vertical direction to the conveying direction was conveyed in the width direction and a temperature region in which no contamination was caused by the fixing offset (non offset temperature region) was observed. Evaluation was carried out according to the following norms.

Evaluation Norms

A: The lower limit of temperature of the non offset region was not more than 110° C. and the temperature region was not less than 15° C.

B: The lower limit of temperature of the non offset region was not more than 120° C. and the temperature region was less than 15° C.

C: The lower limit of temperature of the non offset region was not less than 125° C.

(Internal Image Lacking)

Evaluation of the internal image lacking was carried out as follows. An original image sheet of A4 size on which a hundred dots of diameter of 0.5 mm, 1.0 mm and 1.5 mm were each printed was copied onto A4 size printing paper (weight of 64 g/m$^2$) at the initial time and after 200,000 prints under ordinary temperature and humidity (20° C., 50% RH). The degree of internal image lacking in the each of the copied dots was evaluated.

An original having a image ratio of 2% was used for the 200,000 sheets if printing.

Evaluation Norms

A: No internal image lacking was observed.

B: Four or less internal image lacking were observed but no problem was caused in practical use.

C: Five or more internal image lacking were observed and problem was caused in practical use.

<Evaluation Results>

Evaluation results are shown in Table 2.

TABLE 2

| | Low temperature fixing ability | Internal image lacking in dot (Initial) Diameter of 0.25 mm | Diameter of 0.5 mm | Diameter of 1.0 mm | Internal image lacking in dot (After 200,000 prints) Diameter of 0.25 mm | Diameter of 0.5 mm | Diameter of 1.0 mm |
|---|---|---|---|---|---|---|---|
| Example 1 | A | A | A | A | A | A | A |
| Example 2 | A | A | A | A | A | A | A |
| Example 3 | B | A | A | A | A | A | A |
| Example 4 | A | A | A | A | A | A | A |
| Example 5 | A | A | A | A | A | A | A |
| Example 6 | A | A | A | A | B | A | A |
| Example 7 | A | A | A | A | B | B | A |
| Example 8 | A | A | A | A | B | A | A |
| Example 9 | A | A | A | A | A | A | A |
| Comp. 1 | A | A | A | A | C | C | C |
| Comp. 2 | C | A | A | A | A | A | A |
| Comp. 3 | A | C | C | C | C | C | C |
| Comp. 4 | A | C | B | B | C | C | C |
| Comp. 5 | A | C | B | B | C | C | C |
| Comp. 6 | A | C | C | C | C | C | C |
| Comp. 7 | A | C | C | C | C | C | C |

Comp.: Comparative example

As is shown in Table 2, Examples 1 to 9 according to the invention gave good results as to entire evaluation items. Contrary to that, problems were caused in any one of the evaluated items as to Comparative Examples 1 to 7 without the invention and it is confirmed that the effects of the invention is not realized.

The invention claimed is:

1. An image forming method comprising steps of;

cleaning a toner remaining on a photoreceptor surface by a cleaning blade which is arranged in a counter direction to a rotation direction of the photoreceptor, supplying a fatty acid metal salt onto the photoreceptor surface after the cleaning, spreading the supplied fatty acid metal salt on the photoreceptor surface by using a spreading blade which is arranged in a trail direction with respect to the rotation direction of the photoreceptor, charging the photoreceptor by a charging member, exposing the photoreceptor to form a latent image, developing the latent image by a developer to form a toner image on the photoreceptor, and transferring the toner image onto an image receiving material by a transfer roller, wherein the toner comprises a binder resin and a colorant, in which the toner has a glass transition point of from 20 to 45° C. and the binder resin contains 50% or more of vinyl polymer resin by weight based on the whole weight of the binder resin.

2. The image forming method of claim 1, wherein the binder resin contains 80% or more of the vinyl polymer resin by weight based on the whole weight of the binder resin.

3. The image forming method of claim 1, wherein the vinyl polymer resin is composed of at least one kind of a monomer selected from the group consisting of styrene or its derivatives, methacrylic acid ester or its derivatives, acrylic acid ester or its derivatives, acrylic acid and methacrylic acid.

4. The image forming method of claim 1, wherein the vinyl polymer resin is a copolymer of copolymerizable monomers comprising at least one kind of a monomer selected from the group consisting of propyl acrylate, propylmethacrylate, butylacrylate, 2-ethyhexylacrylate and laurylacrylate, and a monomer selected from the group consisting of styrene, methylmethacrylate and methacrylic acid.

5. The image forming method of claim 1, wherein the toner is a core shell toner.

6. The image forming method of claim 1, wherein the fatty acid metal salt is a metal salt of a saturated or unsaturated fatty acid having 10 or less carbon atoms.

7. The image forming method of claim 6, wherein the fatty acid metal salt comprises one or more kinds of compounds selected from the group consisting of calcium stearate, aluminum stearate, indium stearate, gallium stearate, zinc stearate, lithium stearate, magnesium stearate, sodium stearate, aluminum palmitate and aluminum oleate.

8. The image forming method of claim 1, wherein the spreading blade is touched to the photoreceptor at an obtuse angle.

9. The image forming method of claim 1, wherein the spreading blade is touched to the photoreceptor at 135-180°.

10. The image forming method of claim 1, wherein the cleaning blade is touched to the photoreceptor at an acute angle.

11. The image forming method of claim 10, wherein the cleaning blade is touched to the photoreceptor at 5-35°.

12. The image forming method of claim 1, wherein the cleaning blade is composed of urethane rubber, silicone rubber, fluorine-containing rubber, chloroprene rubber or butadiene rubber.

13. The image forming method of claim 1, wherein the spreading blade is composed of urethane rubber, silicone rubber, fluorine-containing rubber, chloroprene rubber or butadiene rubber.

14. The image forming method of claim 1, wherein the fatty acid metal salt is supplied onto the photoreceptor surface in an amount of from 0.1 to 0.5 $mg/m^2$.

15. The image forming method of claim 1, wherein the fatty acid metal salt is supplied onto the photoreceptor surface in an amount of from 0.1 to 0.3 $mg/m^2$.

16. The image forming method of claim 1, wherein the charging member is not in contact with the photoreceptor.

17. The image forming method of claim 1, wherein the fatty acid metal salt is supplied onto the photoreceptor surface by a brush roller.

* * * * *